US007588300B2

(12) United States Patent
Koga et al.

(10) Patent No.: US 7,588,300 B2
(45) Date of Patent: Sep. 15, 2009

(54) IMAGE-FORMING APPARATUS

(75) Inventors: Yuji Koga, Nagoya (JP); Shohei Koide, Nagoya (JP); Tetsuya Ouchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 243 days.

(21) Appl. No.: 11/236,659

(22) Filed: Sep. 28, 2005

(65) Prior Publication Data

US 2006/0066647 A1 Mar. 30, 2006

(30) Foreign Application Priority Data

Sep. 30, 2004 (JP) ..... 2004-289359

(51) Int. Cl.
*B41J 29/38* (2006.01)
*B41J 19/00* (2006.01)
*B41J 11/42* (2006.01)

(52) U.S. Cl. ..... 347/5; 347/35; 347/36; 400/279; 400/283

(58) Field of Classification Search ..... 347/35, 347/9, 19, 16, 5, 12, 36, 41; 400/279, 283
See application file for complete search history.

(56) References Cited

U.S. PATENT DOCUMENTS 5,871,291 A * 2/1999 Kawazoe ..... 400/279
6,239,817 B1 5/2001 Meyer
6,663,216 B2 * 12/2003 Kanaya ..... 347/23
6,695,432 B2 * 2/2004 Kanda ..... 347/41
6,805,427 B2 10/2004 Hosono
6,827,511 B2 * 12/2004 Uchikata ..... 400/283
7,287,826 B2 * 10/2007 Aldrich et al. ..... 347/35
2003/0151639 A1 8/2003 Takahashi

FOREIGN PATENT DOCUMENTS

EP 1 059 168 12/2000
JP 61-29270 B2 2/1986

(Continued)

OTHER PUBLICATIONS

Translated Summary of Japanese Office Action of Japanese Patent Application No. 2004-289356 dated Aug. 19, 2008.

*Primary Examiner*—Lam S Nguyen
(74) *Attorney, Agent, or Firm*—Banner & Witcoff, Ltd

(57) ABSTRACT

An image-forming apparatus is capable of performing a non-margin recording operation without a margin on a recording medium and providing a waiting time between a moment of termination of a movement of a carriage in one of opposite directions and a moment of initiation of a subsequent movement of the carriage in the other direction, if the non-margin recording operation is performed during the movement of the carriage in the above-indicated one direction. The carriage is moved in the other direction (returned) at a speed lower than that of the movement in the above-indicated one direction, so that the back surface of an edge portion (e.g., leading end portion) of the recording medium is protected from contamination with an ink mist produced from the ink droplets. The waiting time and the return speed of the carriage can be manually selected or changed by using an operator's control panel, so that the non-margin recording operation can be performed in a desired manner (in a high-image-quality mode or a high-speed mode).

17 Claims, 9 Drawing Sheets

FOREIGN PATENT DOCUMENTS

| | | | |
|---|---|---|---|
| JP | 2000118058 | | 4/2000 |
| JP | 2001-10145 | A | 1/2001 |
| JP | 2002-1995 | A | 1/2002 |
| JP | 2002-52743 | A | 2/2002 |
| JP | 2003-320688 | A | 11/2003 |
| JP | 2004-90463 | A | 3/2004 |
| JP | 2004-181826 | A | 7/2004 |
| JP | 2004-195749 | A | 7/2004 |

* cited by examiner

FIG.4

| TYPE OF PRINTING | PRINTING MODE | PRINTING DIRECTION | WAITING TIME(s) | RETURN SPEED(ips) |
|---|---|---|---|---|
| NON-MARGIN PRINTING | HIGH-QUALITY | UNIDIRECTIONAL | 0 | 4 |
| | | | 1 | 4 |
| | | | 2 | 4 |
| | | | 3 | 4 |
| | HIGH-SPEED | BIDIRECTIONAL | 0 | 40 |
| | | | 1 | 40 |
| | | | 2 | 40 |
| | | | 3 | 40 |
| NORMAL PRINTING | HIGH-SPEED | BIDIRECTIONAL | 0 | 40 |

| WAITING TIME (s) / OFFSET DISTANCE (mm) | 1. 0 | 2. 0 | 3. 0 | 4. 0 |
|---|---|---|---|---|
| 1 (RETURN SPEED OF 40 ips) | 44. 7 | 33. 3 | 8. 1 | 3. 0 |
| 0.5 (RETURN SPEED OF 40 ips) | 26. 6 | 7. 0 | 6. 3 | |
| 0.5 (RETURN SPEED OF 4 ips) | 2. 0 | 0. 0 | 0. 0 | 0. 0 |

IMAGE-FORMING APPARATUS

The present application is based on Japanese Patent Application No. 2004-289359 filed on Sep. 30, 2004, the contents of which are incorporated herein by reference.

BACKGROUND OF THE INVENTION

1. Field of the Invention

The present invention relates in general to an image-forming apparatus, and more particularly to an image-forming apparatus arranged to be capable of performing a so-called "non-margin recording operation", namely, an operation to record an image, without a margin left along an edge of a recording medium (e.g., a sheet of paper), for example, to record an image over an entire length of the recording medium, without top and bottom margins being left on a recording surface of the recording medium, 2. Discussion of Related Art In a conventional printer of ink-jet type, a recording head has a nozzle surface in which ink-ejecting nozzles are open, and is mounted on a carriage reciprocable in a main scanning direction, such that the nozzle surface faces downwards. When a recording operation is performed on a recording medium (e.g., a sheet of paper) by the recording head, the recording medium is intermittently fed or advanced by a predetermined incremental distance in a secondary scanning direction perpendicular to the main scanning direction. The recording medium being fed is supported by and moved on a platen disposed below the nozzle surface of the recording head, while an image is recorded on an upper recording surface of the recording medium, with droplets of ink ejected from the nozzles of the recording head.

When the so-called "non-margin" recording operation is performed without the top and bottom margins left along the leading and trailing edges of a recording medium, the ejection of the ink from the nozzles is initiated shortly before the leading edge of the recording medium has reached the downstream end of a predetermined effective recording area set in the printer, in the feeding direction of the recording medium, and is terminated shortly after the trailing edge has reached the upstream end of the effective recording area. The effective recording area is substantially opposed to the nozzle surface of the recording head in which the nozzles used for recording an image are formed and located, and has an effective recording length (as seen in the medium feeding direction) over which the ink droplets ejected from the nozzles are received or deposited. In this non-margin recording operation, therefore, the ink droplets may be deposited on-areas of the upper surface of the platen which are ahead of the leading edge of the recording medium and behind the trailing edge, as seen in the medium feeding direction. The ink droplets deposited on the platen cause a problem of contamination of the back or lower surface of the following recording media when these media are slidably moved on the platen.

JP-2000-118058A discloses an example of a solution to overcome the above-indicated problem, by forming the platen so as to have an upstream wall and a downstream wall which extend upright and in the main scanning direction and which are located on the respective upstream and downstream sides of the image-recording area of the printer and spaced apart from each other in the feeding direction of the recording medium such that those upstream and downstream upright walls partially define therebetween a container which is open upwards and in which an ink absorber for absorbing the ink droplets is accommodated. The upstream and downstream walls have respective rows of ribs formed on their upper end faces. See FIGS. 3, 4A, 4B and 4C of the above-identified publication JP-2000-118058A.

According to the solution disclosed in the above-identified publication, however, the ink absorbing material must be accommodated in the container of the platen such that the upper surface of the ink absorber is not located above the level of the upper ends of the ribs, to avoid a contact of the upper surface of the ink absorber with the recording medium being fed in sliding contact with the upper ends of the ribs. To assure a high degree of freedom of the recording medium from its contact with the ink absorber, the ink absorber must be accurately dimensioned and carefully installed within the container, undesirably requiring a high cost of manufacture of the ink absorber and time-consuming installation of the ink absorber in the container.

For effective absorption of the ink droplets by the ink absorber, on the other hand, it is necessary to form the platen with a sufficiently large area of opening of the container, so that the spacing distance between the upstream and downstream walls in the feeding direction of the recording medium is inevitably made large. The large spacing distance tends to cause the leading and trailing end portions of the recording medium to fall or deflect downwards and contact with the upper surface of the ink absorber in the container, if the recording medium has a relatively small thickness or a relatively low degree of stiffness, after the leading and trailing edges of the recording medium have passed the respective upstream and downstream walls of the container, with the recording medium being supported in a cantilever fashion at its leading and trailing end portions by the ribs of the upstream and downstream walls. Accordingly, the back surface of the recording medium may be contaminated with the ink at its leading and trailing end portions.

The non-margin recording operation has another drawback that the ink droplets ejected outside the recording medium cause an ink mist that also undesirably contaminates the recording medium, particularly, its back surface. In this respect, it is noted that a recent demand for a high resolution of image reproduction requires size reduction of the ink droplets, which leads to easier generation of the ink mist. Thus, there has been a need of assuring a high quality recording operation with a high image resolution while preventing the contamination of the recording medium with the ink.

SUMMARY OF THE INVENTION

The present invention was made in view of the background art described above. It is therefore an object of the present invention to provide an image-forming apparatus which permits a non-margin recording operation with a reduced risk of contamination of the recording medium with an ink.

The object indicated above may be achieved according to the principle of this invention, which provides an image-forming apparatus comprising (a) a recording head operable to eject ink droplets for forming an image on a recording medium, (b) a movable body on which the recording head is mounted, (c) a driving device operable to reciprocate the movable body in a main scanning direction, (d) a medium feeding device operable to feed the recording medium in a secondary scanning direction intersecting the main scanning direction, and (e) a control device operable to control the recording head, the driving device and the medium feeding device, to perform a recording operation to form the image on the recording medium, the recording operation including a non-margin recording operation in which the image is formed with said ink droplets on the recording medium, without a margin left along an edge of the recording medium, and wherein the control device includes at least one of (i) a waiting-time control portion which is operable in the non-margin recording operation, to provide a predetermined waiting time between a moment of termination of a movement of the movable body in one of opposite directions parallel to the main scanning direction and a subsequent movement of the movable body in the other of the opposite directions, if the non-margin recording operation by the recording head is performed during the movement of the movable body in the above-indicated one of the opposite directions, and (ii) a speed control portion which is operable in the non-margin recording operation, to control the driving device such that after the movable body is moved in one of opposite directions parallel to the main scanning direction while the non-margin recording operation is performed by the recording head, the movable body is moved in the other of the opposite directions at a lower speed lower than that of the movement of the movable body in the above-indicated one of the opposite directions.

In the image-forming apparatus according to the first aspect of this invention constructed described above, the control device controls the driving device and the medium feeding device such that the movable body is reciprocated by the driving device in the main scanning direction, and the recording medium is fed by the medium feeding device in the secondary scanning direction intersecting the main scanning direction. The control device is operable to control the recording head as well as the driving device and the medium feeding device, so as to perform the non-margin recording operation in which the image is formed with the ink droplets ejected by the recording head mounted on the movable body, without a margin left along an edge of the recording medium. Where the control device includes the waiting-time control portion operable in the non-margin recording operation, the waiting-time control portion controls the recording head and the driving device such that a predetermined waiting time is provided between the moment of termination of one movement of the movable body in one direction (parallel to the main scanning direction) during which the non-margin recording operation is performed, and the moment of initiation of a subsequent movement of the movable body in the other direction (parallel to the main scanning direction). Thus, the movement of the movable body following the movement of the movable body during which the non-margin recording operation is performed takes place only after the predetermined waiting time has passed after the moment of termination of the former movement of the movable body.

The provision of the waiting time in the non-margin recording operation permits the movable body to be returned to the recording start position in the main scanning direction only after a larger portion of the ink mist generated from the ink droplets ejected toward the edge portion (e.g., leading end portion) of the recording medium and an area outside the edge portion has fallen onto a medium support portion (e.g., platen) of the apparatus supporting the recording medium. The ink mist which has fallen on the support portion changes into an ink mass, which is not likely to revert into an ink mist. The amount of the ink mist which has fallen and changed into the ink mass increases with an increase of the waiting time provided before the moment of initiation of the subsequent movement of the movable body following the movement of the movable body during which the non-margin recording operation is performed. In other words, the amount of the ink in the form of a mist at the moment of initiation of the subsequent movement of the movable body can be reduced by providing the waiting time, so that the amount of the ink mist which floats in a space between the recording head and the recording medium during the subsequent movement of the movable body can be reduced by providing the waiting time. Thus, the provision of the waiting time before initiation of the subsequent movement of the movable body is effective to prevent the non-margin recording operation with intermittent movements of the recording head with the movable body in a misty state of the ink floating between the recording head and the recording medium, whereby a risk of contamination of the recording medium with the ink mist can be significantly reduced. In particular, the provision of the waiting time is effective to reduce the risk of contamination of the back surface of the recording medium with the ink mist during the return movement of the movable body to the recording start position.

A recent demand for a high resolution of image reproduction requires size reduction of the ink droplets, which leads to easier generation of the ink mist and a tendency toward an increased amount of generation of the ink mist. However, the provision of the waiting time according to the present invention permits the movable body and recording head to be returned to the recording start position only after the amount of the floating ink mist is reduced, making it possible to perform the recording operation for a high-quality image formed with ink droplets of a small size, while preventing or reducing the risk of contamination of the recording medium with the ink mist.

Where the control device includes the speed control portion also operable in the non-margin recording operation, the speed control portion controls the driving device such that the movement of the movable body in one of the opposite directions during which the non-margin recording is performed by the recording head is followed by the movement of the movable body in the other direction at a lower speed which is lower than that of the movement in the above-indicated one direction. The movement of the movable body at the lower speed in the other direction is effective to reduce a risk of contamination of the recording medium with an ink mist generated in the movement of the movable body in the above-indicated other direction.

The driving device to move the movable body is usually controlled by a control device such that the movable body is moved at a predetermined fixed speed which is determined to assure a desired quality of the image formed by the ink droplets ejected by the recording head. The speed control portion of the control device according to the present invention, the movable body is returned in the above-indicated other direction to the recording start position at the lower speed lower than that of the movement of the movable body in the above-indicated one direction during which the non-margin recording operation is performed. The reduction of the speed of the return movement of the movable body in the above-indicated other direction to the recording start position is effective to reduce the volume of air flow caused by that movement, and is accordingly effective to reduce the amount of the ink mist floating between the recording head and the recording medium. Therefore, the reduction of the speed of the return movement is effective to reduce the risk of contamination of the recording medium with an ink mist generated by the ink droplets ejected toward the edge portion (e.g., leading end portion) of the recording medium and an area outside the edge portion. In particular, the reduction of the speed of the return movement of the movable body is effective to reduce the risk of contamination of the back surface of the recording medium with the ink mist during the return movement of the movable body.

The reduction of the speed of the movement of the movable body in the above-indicated other direction by the speed control portion is also effective to reduce the amount of the ink mist floating between the recording head and the recording medium during the movement of the movable body in the above-indicated other direction, making it possible to perform the recording operation for a high-quality image formed with ink droplets of a small size, while preventing or reducing the risk of contamination of the recording medium with the ink mist.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which:

FIG. 4 is a view indicating different configurations of printing operation performed by the image-forming apparatus;

DETAILED DESCRIPTION OF THE PREFERRED EMBODIMENT

Figure 1:
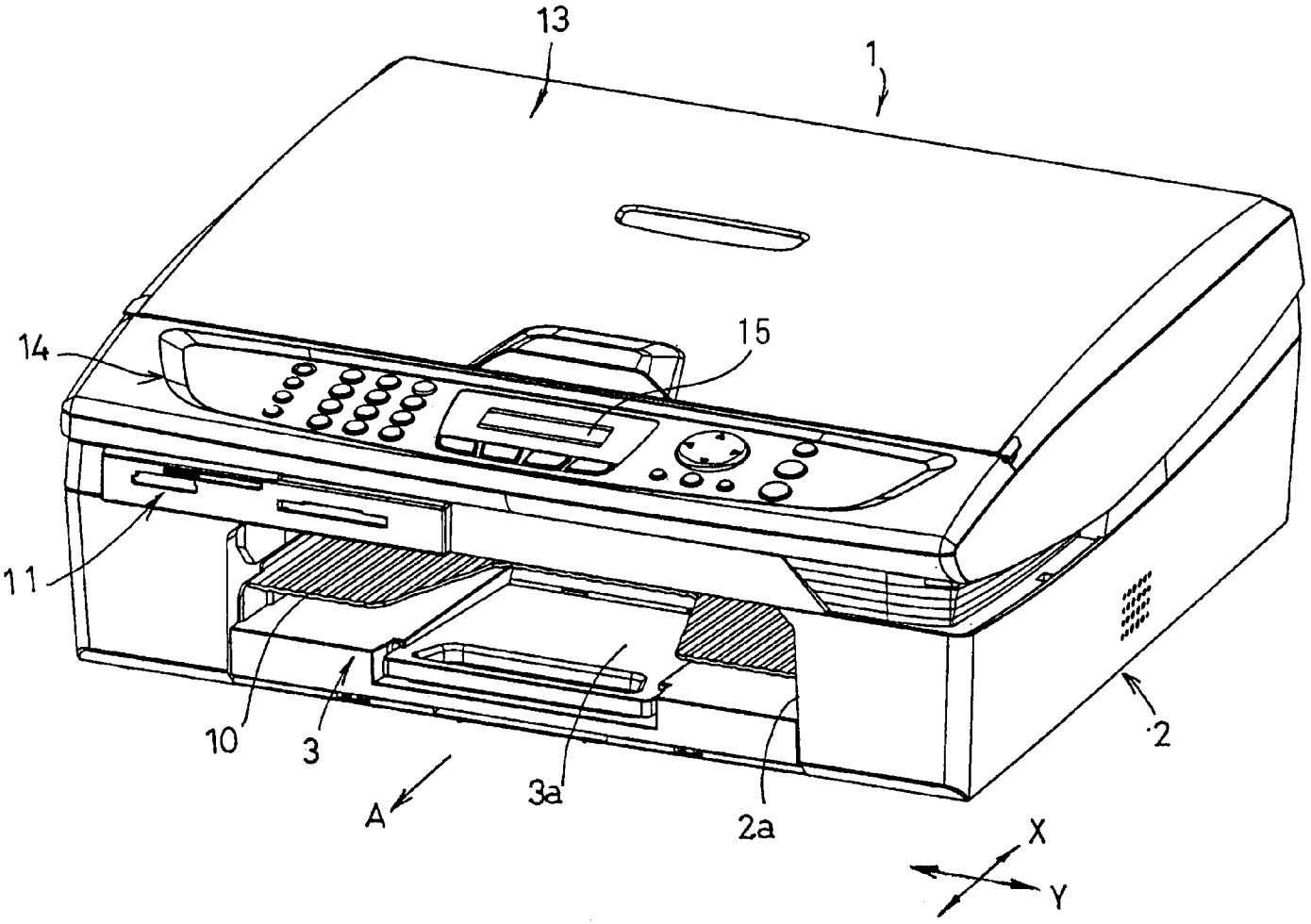
FIG. 1 is a perspective view of an image-forming apparatus constructed according to one embodiment of the present invention.
Figure 2:
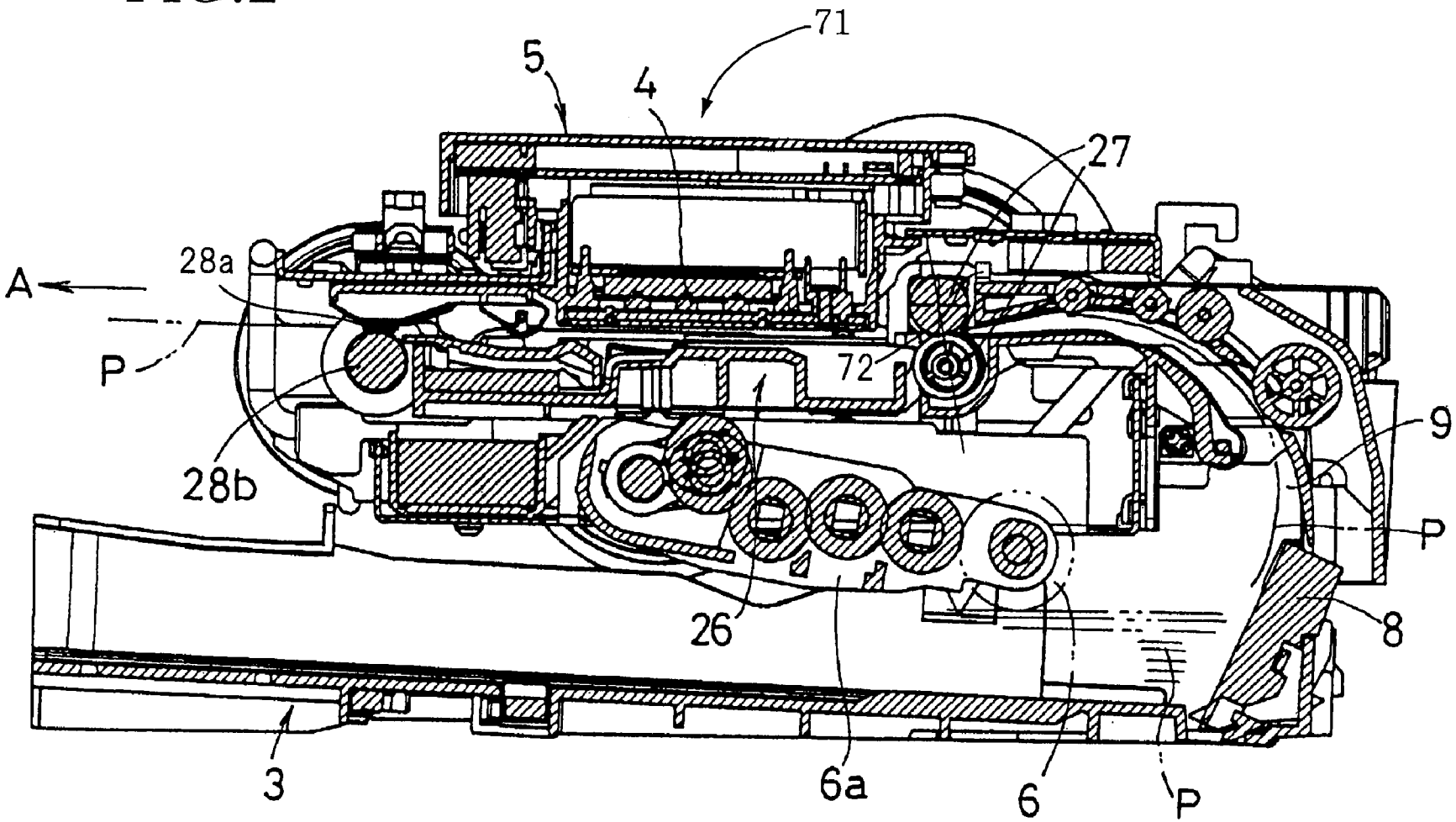
FIG. 2 is an elevational view in cross section of a printing device of the image-forming apparatus.
Figure 3:
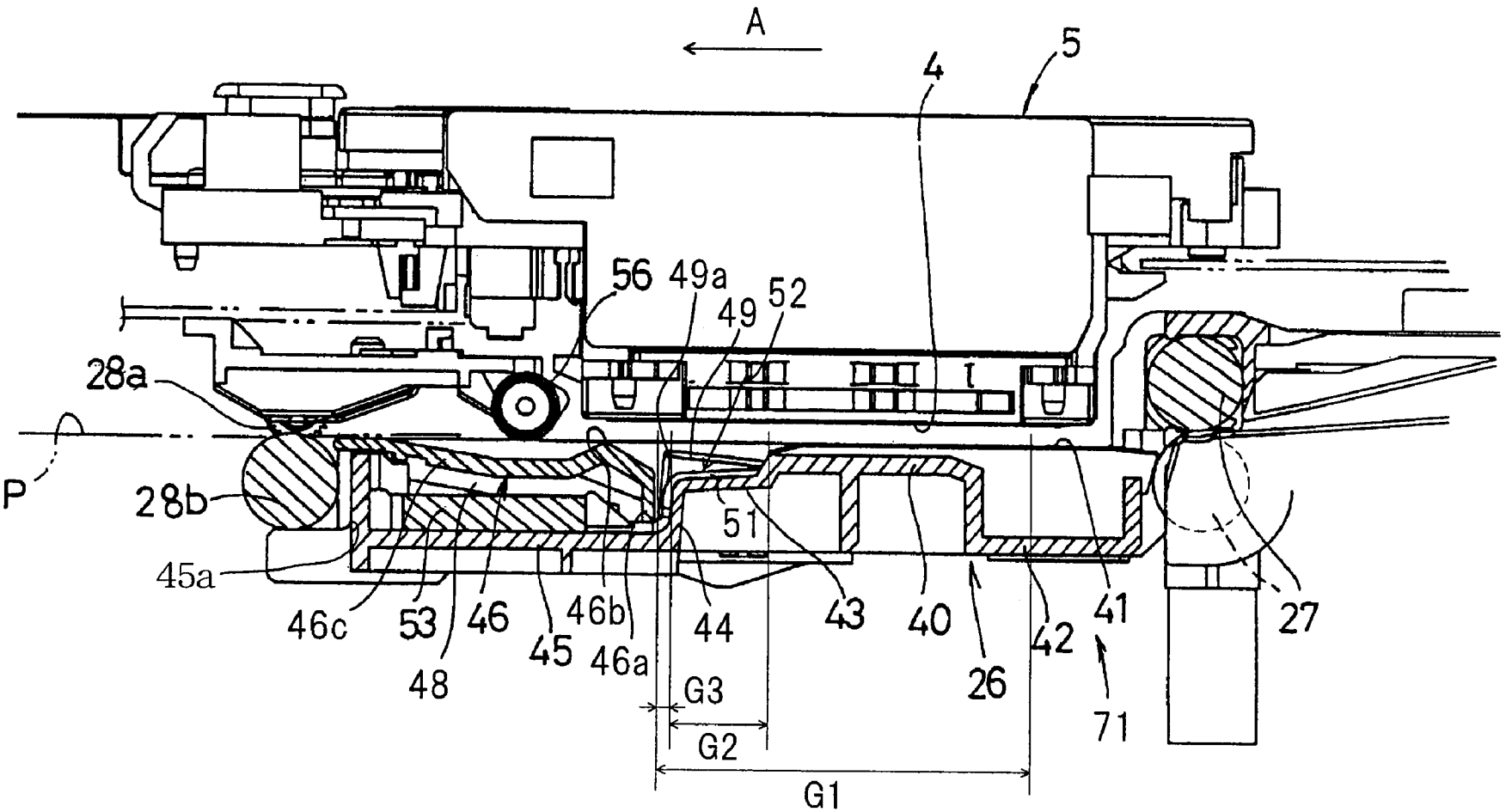
FIG. 3 is a fragmentary side elevational view in cross section of the printing device.

Referring to FIGS. 1-3, there is shown an image-forming apparatus 1 in the form of a multi-function device (MFD) constructed according to one embodiment of the present invention, which has a printing function, a copying function, a scanning function and a facsimile (telecopier) function. However, the Image-forming apparatus 1 may be an ink-jet printer having only the printing function. Although a recording medium on which an image is recorded by the image-forming apparatus 1 is a sheet of paper P in the present embodiment, the recording medium may be any other kinds of sheets such as a plastic film.

The image-forming apparatus 1 is capable of performing not only a normal printing (recording) operation with top, bottom and side margins, but also a non-margin printing (recording) operation without the top and bottom margins being left along the leading and trailing edges of the paper sheet P (but with the right and left margins being left along the right and left edges of the paper sheet P).

As shown in FIG. 1, the image-forming apparatus 1 has a main body in the form of a housing 2, which is formed of a synthetic resin and having an internal space which is open through a front opening 2*a* on its front side. The internal space is separated into upper and lower sections. In the upper section, there is removably installed a sheet supply cassette 3 which accommodates a stack of paper sheets P and from which the paper sheets P are fed one after another. In the lower section, there is formed a printed-sheet receiver 10 on which the printed paper sheets P are accumulated. Arrow-headed line A in FIG. 1 indicates a direction of feeding of the paper sheet P after the paper sheet P is printed.

In the present embodiment, the sheet supply cassette 3 accommodates a stack of recording media in the form of cut sheets of paper P of a selected size such as A4 size, letter size or legal size, as shown in FIG. 2, such that the short sides of the paper sheets P are parallel to a main scanning direction, namely, parallel to a Y-axis direction perpendicular to an X-axis direction (feeding direction of the cut sheets P). The X-axis and Y-axis directions are indicated in FIG. 1. The sheet supply cassette 3 has an auxiliary sheet support 3*a* at its front end portion, as shown in FIG. 1. This auxiliary sheet support 3*a* is movable in the X-axis direction between an inner position of FIG. 1 and an outer position on the front side of the housing 2. When an image is printed on the paper sheet P such as the legal size sheet which has a large length and cannot be accommodated in the sheet supply cassette 3, this paper sheet P is inserted into the image-forming apparatus 1 through a passage between the sheet supply cassette 3 and the printed-sheet receiver 10. In this case, the auxiliary sheet support 3*a* is pulled to its outer position to support the long cut sheet P at its trailing end portion which projects from the main body of the sheet supply cassette 3. When an image is printed on the relatively short paper sheet P such as the A4 size sheet entirely accommodated in the sheet supply cassette 3, the auxiliary sheet support 3*a* is placed in its inner position of FIG. 1.

In an upper portion of the housing 2, there is disposed an image-reading device operable to read an original to be copied or transmitted by the copying or facsimile function. The image-reading device is pivotally attached at one of its opposite lateral ends to the corresponding lateral end of the housing 2 such that the image-reading device is pivotable about a horizontal axis. The image-reading device includes an original covering member 13, which is provided to cover the original and which is pivotally attached at its rear end to the rear end of the image-reading device such that the original covering member 13 is also pivotable about a horizontal axis.

The original to be read is placed on a glass plate which is exposed when the original covering member 13 is opened upwards. An image carried by the original is read by a scanner (contact image sensor) 70 (shown in FIG. 5) which is disposed below the glass plate and reciprocable in the main scanning direction (Y-axis direction).

In the upper portion of the housing 2, there are also provided an operator's control panel 14 and a liquid crystal display (LSD) 15, which are located in front of the original covering member 13. The operator's control panel 14 is provided with various control keys used to control the image-forming apparatus 1, and the LCD 15 displays various information or indications relating to operating procedures and status of the apparatus 1. In a front portion of the housing 2 which is located below the operator's control panel 14, there is provided an external-memory receptacle 11 into which an external memory can be inserted. The external memory may be "compact flash", "smart media", "Memory stick-", "SD card" and "xD", all of which are registered trademarks.

As shown in FIG. 2, the image-forming apparatus 1 includes a printing device 71 operable to perform a printing operation on the paper sheet P. Below the printing device 71 and on the rear side (on the right side as seen in FIG. 2) of the sheet supply cassette 3, there is formed a sheet separator wall 8 which functions to separate the uppermost paper sheet P from the stack in the sheet supply cassette 3. On the front side (on the left side as seen in FIG. 2) of the separator wall 8, that is, on the upstream side of the sheet separator wall 8 as viewed in the direction of feeding of the paper sheet P from the sheet supply cassette 3, there is disposed a roller support arm 6*a* which is pivotally supported at its proximal end portion by the housing 2 such that the roller support arm 6*a* is pivotable about a horizontal axis. This roller support arm 6*a* supports a sheet supply roller 6 at its distal or free end portion, and is pivotally biased to hold the sheet supply roller 6 in pressing contact with the uppermost paper sheet P of the stack accommodated in the sheet supply cassette 3.

A rotary motion of the sheet supply roller 6 in the counterclockwise direction as seen in FIG. 2 causes the paper sheets P to be fed from the stack in the sheet supply cassette 3, one after another, in the presence of the sheet separator wall 8 which is inclined obliquely and rearwardly with respect to the sheet supply cassette 3. The paper sheet P fed from the sheet supply cassette 3 is advanced along a U-turn path 9 to a pair of registering rollers 27 which is located on the front side of the sheet separator wall 8 and above the sheet supply cassette 3.

The printing device 71 includes: an ink-jet printing head 4 operable to perform a printing operation on the paper sheet P; a carriage 5 which carries the printing head 4 and is reciprocable in the main scanning direction; a guiding device (not shown) which guides the carriage 5 and has a pair of guide members extending in the direction of reciprocation of the carriage 5; a timing belt (not shown) which is disposed on the upper surface of the downstream one of the two guide members (as viewed in sheet feeding direction A), so as to extend in the direction of extension of the downstream guiding member; a carriage drive motor 25 (shown in FIG. 5) which is operatively connected to the timing belt to reciprocate the carriage 5 and which is a DC motor in the present embodiment, but may be a stepping motor; a generally plate-like platen 26 for supporting the paper sheet P being fed under the printing head 4; and an encoder strip which extends in the main scanning direction (Y-axis direction) and which is provided to detect the position of the carriage 5 in the Y-axis direction (main scanning direction). The encoder strip has a vertical detecting surface in which a multiplicity of slits is formed with a predetermined spacing pitch in the Y-axis direction. The carriage 5 has a home position on one side of one end of the encoder strip which is remote from the other end. This home position is detected by a carriage-home-position sensor 73 (shown in FIG. 5).

The printing device 71 includes the above-described pair of registering rollers 27 to advance the paper sheet P fed by the sheet supply roller 6, to a position between the printing head 4 and the platen 26. That is, the paper sheet P is advanced in the sheet feeding direction A to the position between the lower surface of the printing head 4 and the upper surface of the platen 26, when the upper registering roller 27 is rotated clockwise while the lower registering roller 27 is rotated counterclockwise. The upper registering roller 27 is a drive roller rotated by a sheet feeding motor 79 (shown in FIG. 5), while the lower registering roller 27 is a driven or idler roller rotated by the upper drive roller 27. However, the upper and lower registering rollers 27 may be driven and drive rollers, respectively, or may be both drive rollers. The registering rollers 27 are rotated bidirectionally by the sheet feeding motor 79. Namely, the registering rollers 27 are rotated in the forward direction to advance the paper sheet P in the sheet feeding direction A after the leading edge of the paper sheet P has reached the registering rollers 27. Before the leading edge of the paper sheet P fed from the sheet supply cassette 3 by the sheet supply roller 6 has reached the registering rollers 27, the registering rollers 27 are rotated in the reverse direction 80 that the paper sheet P is prevented from being advanced by the registering rollers 27 in the sheet feeding direction from the registering rollers 27, whereby the paper sheet P is registered by the registering rollers 27 such that the leading edge is parallel to the main scanning direction (Y-axis direction).

On the upstream side of the registering rollers 27 as seen in the sheet feeding direction A, there is disposed a sheet sensor 72 (shown in FIG. 5) arranged to detect the leading edge of the paper sheet P fed from the sheet supply roller 6. The sheet sensor 72 is a commonly used optical sensor of reflection type including a light emitting diode and a photo transistor. If the leading edge of the paper sheet P is not detected by the sheet sensor 72 during the feeding of the paper sheet P by the sheet supply roller 6, the drive systems including a sheet supply motor 77 to rotate the sheet supply roller 6 and the sheet feeding motor 79 to rotate the upper registering roller 27 are turned off, and an error signal is generated to active the LCD 15 to indicate an error relating to the feeding of the paper sheet P to the registering rollers 27.

On the downstream side of the platen 26, there are disposed a spur roller 28*a*, and an ejector roller 28*b* which is located under the spur roller 28*a* and rotated by the sheet feeding motor 79. The spur roller 28*a* is a driven or idler roller which is rotated by the ejector roller 28*b*. These spur and ejector rollers 28*a*, 28*b* are rotated by the sheet feeding motor 79 by the sheet feeding motor 79, bidirectionally, that is, in the forward direction to advance the paper sheet P in the sheet feeding direction, and in the reverse direction opposite to the forward direction. In the present embodiment, the registering rollers 27, spur roller 28*a* and ejector roller 28*b* are rotated in the forward direction to intermittently advance the paper sheet P in the sheet feeding direction by the predetermined incremental distance. To advance the paper sheet P in the sheet feeding direction A, the spur roller 28*a* is rotated clockwise while the ejector roller 28*b* is rotated counterclockwise, as seen in FIG. 2. The paper sheet P on which the printing operation has been performed is ejected onto the printed-sheet receiver 10 by the counterclockwise rotation of the ejector roller 28*b*.

The printing device 71 further includes: four ink cartridges accommodating respective inks of four colors (black BK, cyan C, magenta M and yellow Y) used to perform a full-color printing operation; ink supply tubes for supplying the inks to the printing head 4 from the respective ink cartridges; a flushing portion arranged to perform a periodic flushing operation of the printing head 4 to eject the ink droplets from the nozzles for the purpose of preventing clogging of the nozzles; and a maintenance unit arranged to clean the nozzle surface of the printing head 4, and to remove air bubbles from a buffer tank mounted on the printing head 4.

Referring further to the fragmentary side elevational view in cross section of FIG. 3 showing the printing head 4 and components near the printing head 4, the nozzle surface of the printing head 4 has four rows of nozzles corresponding to the respective four colors. These four rows of nozzles extend in the X-axis direction and are equally spaced apart from each other in the Y-axis direction by a suitable spacing distance. In the present embodiment, the effective dimension of the nozzle surface of the printing head 4 in the X-axis direction is about one inch, which is the length of each of the four rows of nozzles in the X-axis direction (sheet feeding direction A). Each of the four rows consists of 75 nozzles, so that the image resolution in the X-axis direction is 75 dpi (dots per inch).

As indicated previously, the printing device 71 is capable of performing the normal printing operation with the top, bottom and side margins, and the non-margin printing operation without the top and bottom margins being left on the paper sheet P. The normal printing operation is performed by using all nozzles ($1^{st}$ through 75th nozzles) of each row, which cooperate to define an effective recording area G1 of the printing device 71 (image-forming apparatus 1) for the normal printing operation, as indicated in FIG. 3. The $1^{st}$ nozzle is the most downstream nozzle as seen in the sheet feeding direction A. On the other hand, the non-margin printing operation is performed by using the $7^{th}$ through $28^{th}$ nozzles of each row, which cooperate to define an effective recording area G2 of the printing device 71 for the non-margin printing operation, which has a length of 7.79 mm in the sheet feeding direction A. The $1^{st}$ through $6^{th}$ nozzles of each row cooperate to define a margin area G3 of the printing device 71, which has a length of 1.36 mm in the sheet feeding direction.

Then, the construction of the platen 26 opposed to the printing head 4 will be described in detail. In the present embodiment, the platen 26 is a box-like structure which has a generally rectangular shape as seen in a plan view and which is formed of a synthetic resin. The platen 26 includes a top plate 40 located in an upstream portion thereof as seen in the sheet feeding direction A and having an upper surface opposed and parallel to the paper sheet P being fed. On the upper surface of the top plate 26, there are formed a plurality of upstream ribs 41 which extend in the sheet feeding direction (X-axis direction) and which are equally spaced apart from each other in the Y-axis direction by a suitable spacing distance. A U-shaped portion 43 located upstream of the top plate 40 as seen in the sheet feeding direction A is formed integrally with the top plate 26, which is elongate in the Y-axis direction. The U-shaped portion 42 is U-shaped in cross section of FIG. 3 and is open upwards. A step down plate 53 located downstream of the top plate 40 as seen in the sheet feeding direction A is also formed integrally with the top plate 26. The step-down plate 43 has a smaller height than the top plate 40.

The dimension of the step-down plate 43 in the sheet feeding direction A (X-axis direction) is almost equal to the effective area G2 for the non-margin printing operation. The step-down plate 43 is inclined downwards as it extends in the sheet feeding direction A. An upright wall 44 is formed integrally with the step-down plate 43, at the downstream end of the step-down plate 43. A bottom plate 45 is formed so as to extend horizontally in the downward direction from the lower end of the upright wall 44. The bottom plate 45 has an upright wall 45*a* formed at the downstream end. Thus, the top wall 40, U-shaped portion 42, step-down plate 43, upright wall 44 and bottom plate 45 are formed as a one-piece member, which is fixed to a pair of side frames disposed at the opposite ends of the platen 26 as seen in the Y-axis direction.

The platen 26 further includes a one-piece downstream rib 46 in a downstream portion thereof as seen in the sheet feeding direction A, more precisely, at a position on the downstream side of the $1^{st}$ nozzle of the printing head 4, on the downstream side of the effective recording area G1 for the normal printing operation. The downstream rib 46 is elongate in the Y-axis direction, and is removably attached at its opposite longitudinal end portions to the above-indicated pair of side frames of the platen 26. The downstream rib 46 and the bottom plate 45 cooperate to define therebetween a space 48 having a suitable vertical dimension.

As shown in the cross sectional view of FIG. 3, the downstream rib 46 includes an upright wall 46*a* opposed to the upright wall 44, a triangular projection 46*b* extending from the upper end of the upright wall 46*a* in the downward direction as seen in the sheet feeding direction A, and an inclined wall 46*c* extending from the triangular projection 46*b* in the downward direction. The triangular projection 46*b* includes an upwardly inclined surface extending in the downward direction, and a downwardly inclined surface which extends from the upper end of the upwardly inclined surface and which cooperates with the upwardly inclined surface to define two sides of a triangle as seen in the cross sectional view of FIG. 3 and further cooperates with the bottom plate 45 to define the space 48. An ink absorber 53 for absorbing an ink is accommodated in the space 48.

The ink absorber 53 is a porous structure of a porous material such as foamed urethane, which covers an almost entire surface area of the bottom plate 45. The ink absorber 53 has a height dimension determined so that the ink absorber 53 does not contact the lower surface of the downstream rib 46. Since the upper surface of the ink absorber 53 is covered by the downstream rib 46, the ink absorber 53 does not contact the paper sheet P, so that the back surface of the paper sheet P is protected from contamination with the ink. The one-piece downstream rib 46 may be replaced by a plurality of downstream ribs which are spaced apart or separated from each other in the Y-axis direction.

Between the downstream end of the upstream ribs 41 and the upstream end of the downstream rib 46, there are formed a plurality of kinds of intermediate ribs for supporting the leading and trailing end portions of the paper sheet P. These intermediate ribs extend in the sheet feeding direction A (X-axis direction), and include first ribs 49, second ribs (not shown) and third ribs 51. The first ribs 49 project over the upper surface of the step-down plate 43 from a point of connection between the top plate 40 and the step-down plate 53, such that the first ribs 49 are aligned with the respective upstream ribs 41 extending in the sheet feeding direction A. Each third rib 49 has an inclined top wall which is inclined upwards as it extends in the downward direction as seen in the sheet feeding direction A. Each third rib 49 also has an almost upright wall which cooperates with the inclined top wall to define an apex 49*a* and which has a lower end located substantially at the lower end of the upright wall 46*a*. The apex 49*a* has a vertical position slightly lower (by 0.7 mm) than that of a plane which includes the upper surfaces of the upstream ribs 41 and the apex of the triangular projection 46*b* of the downstream rib 46 and on which the paper sheet P is advanced in sliding contact with the upstream ribs 41 and the triangular projection 46*b*.

Each of the above-indicated second ribs of the intermediate ribs is interposed between the adjacent first ribs 49 in the Y-axis direction, and projects over the upper surface of the step-down plate 43 in the horizontal direction. Each of the above-indicated third ribs 51 is interposed between the adjacent first rib 49 and second rib in the Y-axis direction, and projects from the point of connection between the top plate 40 and the step-down plate 43. Each third rib 51 terminates on the upper surface of an intermediate portion of the bottom plate 45 as seen in the sheet feeding direction A. Namely, the third rib 51 has a portion sandwiched between the lower end of the upright wall 46*a* and the upper surface of the bottom plate 45. Each third rib 51 includes an inclined top wall which covers the upper surface of the step-down plate 43 and which is inclined downwards as it extends in the downward direction as seen in the sheet feeding direction A. Each third rib 51 has an upper surface slightly lower than those of the first ribs 49 and second ribs.

The first ribs 49, second ribs and third ribs 51 which are alternately arranged in the Y-axis direction cooperate to define grooves 52 which extend in the sheet feeding direction A and which are open upwards. Each groove 52 has a V-shape in cross section and an upper end corresponding to the point of connection between the top plate 40 and the step-down plate 43, and a lower end on the upper surface of the intermediate portion of the bottom plate 45, substantially at the same position as the lower ends of the third ribs 51.

Described more specifically, the ink absorber 53 is positioned on the upper surface of the bottom plate 45 such that the grooves 52 are held in communication with an upstream end portion of the ink absorber 53, so that the grooves 52 function as ink passages through which ink droplets ejected onto the step-down plate 43 (between the downstream ends of the upstream ribs 41 and the upstream end of the downstream rib 46) are fed into the ink absorber 53. Accordingly, the ink absorber 53 accommodates the ink droplets which are ejected outside the entire recording surface of the paper sheet P during the non-margin printing operation, more precisely, ejected on the downward side of the leading edge of the paper sheet P and on the upstream side of the trailing edge of the paper sheet P, as seen in the sheet feeding direction A.

A portion of the platen 26 between the point of connection of the upstream ribs 41 and the step-down plate 43, and the apex 49*a* of the first ribs 49, in the sheet feeding direction A, is opposed to the $7^{th}$ through $28^{th}$ nozzles (formed over the length of 7.79 mm) of each of the four rows of nozzles of the printing head 4. The effective recording area G2 for the non-margin printing operation is an area in which an image is formed by the ink droplets ejected by the $7^{th}$ through $28^{th}$ nozzles.

A portion of the platen 26 between an intermediate portion of each upstream ribs 41 and a gap between the upright wall 46*a* of the downstream rib 46 and the almost upright wall of each first rib 49, in the sheet feeding direction A, is opposed to the $1^{st}$ through $75^{th}$ nozzles of each row of nozzles of the printing head 4. The effective recording area G1 for the normal printing operation is an area in which an image is formed by the ink droplets ejected by the $1^{st}$ through $75^{th}$ nozzles.

The margin area G3 corresponding to the $1^{st}$ through $6^{th}$ nozzles is left between the downstream ends of the effective recording areas G1 and G2. In the presence of this margin area G3, the downstream rib 46 is free from direct exposure to the ink droplets ejected during the non-margin printing operation.

There will next be described a recording operation of the printing device 71. When the normal recording operation is performed, the ink droplets are ejected by the 75 nozzles corresponding to the effective recording area G1, to record an image on the paper sheet P while the paper sheet P is intermittently advanced in the sheet feeding direction A. In this normal printing operation, the ink droplets are not received in the top, bottom, right and left margins of a suitable distance (e.g., 3-5 mm) which are left along the respective upper, lower, right and left edges of the paper sheet P. The ejection of the ink droplets in the normal printing operation is initiated when the leading edge of the paper sheet P has reached a printing start position which is ahead of the downstream end of the effective recording area G1 by a distance equal to the distance of the top margin in the sheet feeding direction A. When the leading edge of the paper sheet A is located at the printing start position, the leading end portion of the paper sheet A is supported by the upstream ribs 41. On the other hand, the ejection of the ink droplets in the normal printing operation is terminated when the trailing edge of the paper sheet P has reached a printing end position which is behind the upstream end of the effective recording area G1 by a distance equal to the distance of the bottom margin in the sheet feeding direction A. When the trailing edge of the paper sheet A is located at the printing end position, the trailing end portion of the paper sheet A is supported by the upright wall 46*a* of the downstream rib 46.

The leading edge of the downwardly deflecting leading end portion of the paper sheet P is contaminated with the ink when the leading edge is moved in sliding contact with the upper surfaces of the inclined top walls of the first ribs 49 which are spaced apart from each other in the Y-axis direction. However, the entire back surface of the paper sheet P is protected from contamination with the ink.

The leading end portion of the paper sheet P on which an image is formed by the ink droplets is fed to a nip between the spur roller 28*a* and the ejector roller 28*b* on the downstream side of the platen 26 while the leading end portion is supported by the triangular projection 46*b* of the downstream rib 46. The paper sheet P is eventually ejected onto the printed-sheet receiver 10. A spur roller 56 is disposed above the downstream rib 46, to prevent upward buckling of the paper sheet P away from the platen 26, so that a suitable gap is maintained between the nozzle surface of the printing head 4 and the paper sheet P, at a position near the spur roller 56. In the present embodiment, the amount of this gap is about 1.76 mm. If the amount of the gap were excessively large, the ink droplets ejected from the nozzles would tend to be sprayed in the air and change into a mist, which deteriorates the quality of the image formed on the paper sheet P. If the amount of the gap were excessively small, the upper surface of the paper sheet P would tend to be contaminated due to its sliding contact with the nozzle surface. Further, the amount of a gap between the upper surface of the top plate 40 and the nozzle surface of the printing head 4 is about 2.41 mm. If the amount of this gap were excessively large, the ink droplets ejected from the printing head 4 would tend to be sprayed in the air and change into a mist, particularly when the size of the ink droplets is relatively small. The above-indicated amount of the gap between the upper surface of the top plate 40 and the nozzle surface of the printing head 4 is determined to prevent or restrict mist spraying of the ink droplets.

Figure 5:
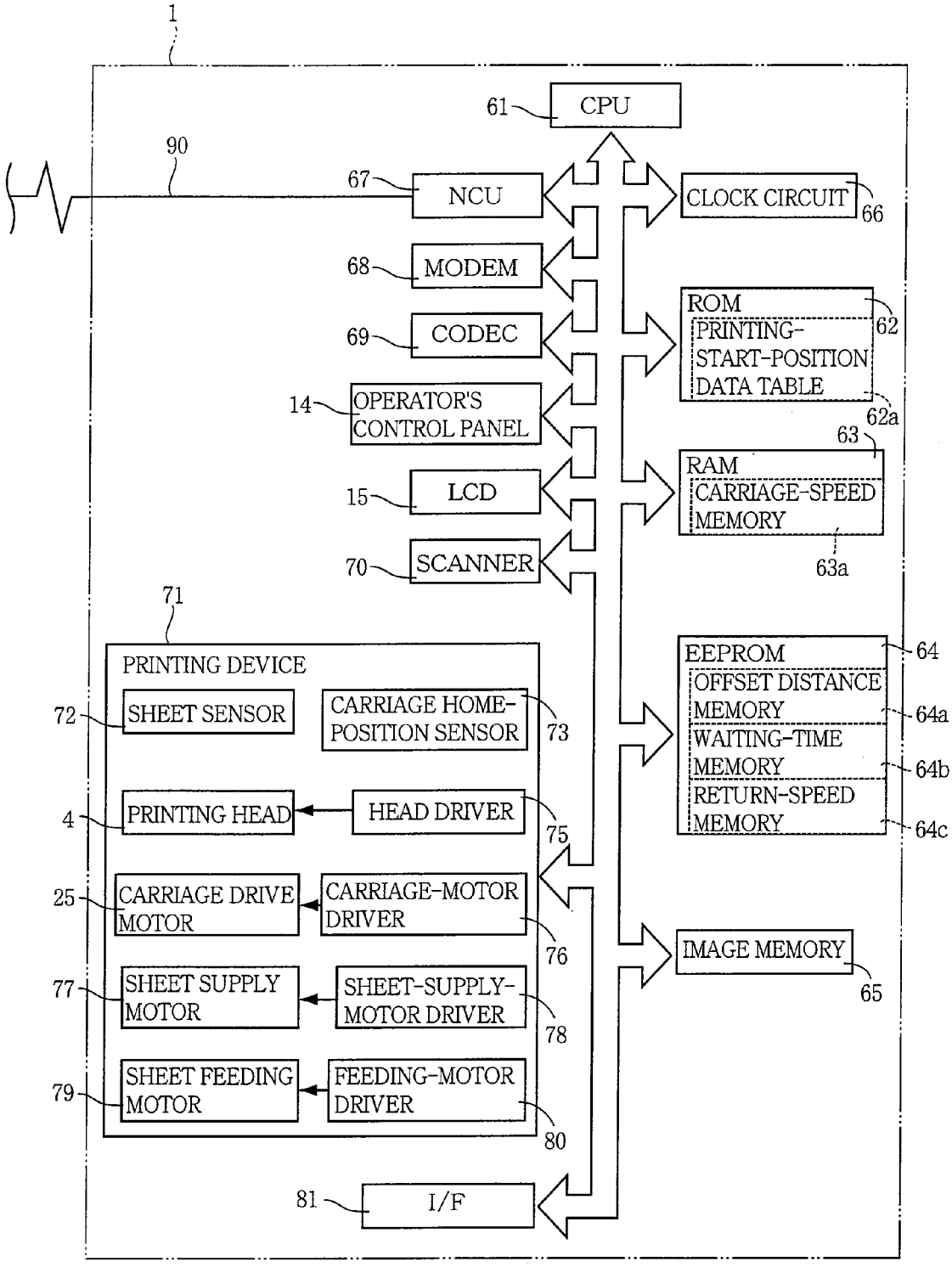
FIG. 5 is a block diagram schematically showing a control system of the image-forming apparatus.

In the non-margin printing operation, the ink droplets are ejected by the 22 nozzles corresponding to the effective recording area G2, to perform the non-margin printing operation according to bit data stored in an image memory 65 (shown in FIG. 5). In this non-margin printing operation, too, the back surface of the paper sheet P is protected from contamination with the ink, for the reason which will be described.

Namely, the ejection of ink droplets from the nozzles of the printing head 4 which correspond to the effective recording area G2 for the non-margin printing operation is initiated when the leading edge of the paper sheet P has entered into the effective recording area G2, that is, has reached the upstream end of the step-down plate 43, during an advancing movement of the paper sheet P while being supported by the upstream ribs 41. To ensure the non-margin printing operation over the entire area of the upper recording surface of the paper sheet P without the top margin, the ink droplets are ejected from those ones of the above-indicated 22 nozzles (corresponding to the effective recording area G2) which are located ahead of the leading edge of the paper sheet P in the downstream direction as seen in the sheet feeding direction A, as well as the nozzles located behind the leading edge of the paper sheet P. Accordingly, the ink droplets ejected from the nozzles relatively distant from the leading edge of the paper sheet P are not deposited on the leading end portion of the paper sheet P, but are deposited on the upper surfaces of the intermediate ribs (first ribs 49, second ribs and third ribs 51 formed within the effective recording area G2) and flow into the grooves 52. Since the vertical positions of the first ribs 49, second ribs and third ribs 51 are lower than that of the upper surfaces of the upstream ribs 41, the back surface of the leading end portion of the paper sheet P does not normally contact with the upper surfaces of those intermediate ribs.

After the leading edge of the paper sheet P has passed the apex 49*a* of the first ribs 49 as a result of a printing operation performed in the extreme leading end portion of the paper sheet P and intermittent advancing movements of the paper sheet P, the ink droplets ejected by the 22 nozzles corresponding to the effective recording area G2 are received by the following upstream portion of the paper sheet P and are not deposited on the intermediate ribs in the form of the first ribs 49, second ribs and third ribs 51. In a terminal portion of the non-margin printing operation, the trailing end portion of the paper sheet P is supported by the triangular projection 49*a* of the downstream rib 49 while the extreme end part of the trailing end portion is supported by the apex 49*a* of the first ribs 49, with the trailing edge of the paper sheet P being located slightly behind the apex 49*a*. To ensure the non-margin printing over the entire area of the upper recording surface of the paper sheet P without the bottom margin, the ink droplets are ejected from those of the above-indicated 22 nozzles which are located behind the trailing edge of the paper sheet Pin the upstream direction, as well as the nozzles located ahead of the trailing edge of the paper sheet P. Accordingly, the ink droplets ejected from the nozzles relatively distant from the trailing edge of the paper sheet P are not deposited on the extreme trailing end portion of the paper sheet P, but are deposited on the upper surfaces of the intermediate ribs in the form of the first ribs 49, second ribs and third ribs 51 and flow into the grooves 52. Since the vertical positions of the first ribs 49, second ribs and third ribs 51 are lower than that of the apex 49*a* of the first ribs 49, the back surface of the trailing end portion of the paper sheet P does not contact with the upper surfaces of those intermediate ribs, and is protected from contamination with the ink.

The ink droplets deposited on the intermediate ribs and flowing into the grooves 52 are fed into the ink absorber 53 through the grooves 52 and along the upright wall 44 and bottom plate 45. According to the principle of the present invention, the intermediate ribs should include at least the first ribs 49, and the grooves 52 should be formed to feed the ink into the ink absorber 53 disposed outside the effective recording area G2 for the non-margin printing operation.

If the ink absorber 53 were disposed within a recording area of the platen 26, for example, disposed below a portion of the platen 36 which corresponds to the effective recording area G1 for the non-margin printing operation or the effective recording area G2 for the normal printing operation, it would be difficult to position the ink absorber 53 so as to prevent a contact of the paper sheet P with the upper surface of the ink absorber 53, and to control the dimensional error of the ink absorber 53 within a relatively narrow tolerance range. In the present embodiment wherein the ink absorber 53 is disposed outside the effective recording areas G1, G2, the ink absorber 53 can be easily positioned so as to prevent its contact with the paper sheet P, and the dimensional control of the ink absorber 53 may be made easier, with a relatively broad tolerance range. Further, it is easy to use the ink absorber 53 having a relatively large size, which has an accordingly long service life and makes it possible to reduce the required interval of replacement of the ink absorber 53. It is noted that the ink absorber 56 located within the platen 26 may be replaced by an ink absorber which is located outside the platen 26 in the sheet feeding direction A. In this modification, the ink droplets deposited on the platen 26 are fed into the ink absorber through a suitable ink passage or passages.

Referring to the block diagram of FIG. 5 an electric control system of the image-forming apparatus 1 will be described. The electric control system of the image-forming apparatus 1 includes a CPU 61, a ROM 62, a RAM 63, an EEPROM 64, the above-indicated image memory 65, a clock circuit 66, a network control unit (hereinafter abbreviated as "NCU") 67, a MODEM 68, a CODEC 69, a scanner 70, the above-described printing device 71, an interface (hereinafter abbreviated as "I/F") 81, and the above-described operator's control panel 14 and LCD 15, which are interconnected to each other through a bus line. The control system may include other elements such as voice LSI, buffers and amplifiers, which are required to perform the printing, copying, scanning and facsimile functions of the image-forming apparatus 1.

The present image-forming apparatus 1 is connected through the NCU 67 to a telephone line (public line) 90. The NCU 67 functions to receive various signals such as call signals from telephone switchboards or exchangers on the public line, and signals indicative of telephone numbers of external devices (transmitters). The NCU 67 further functions to transmit dialing signals generated by operation of the operator's control panel 14, to the telephone switchboards, and receive and transmit analog voice signals during telephone communication with the external transmitters/receivers. When the image-forming apparatus 1 receives data from the external transmitters, the NCU 67 automatically receives the data in response to call signals received through the call signals. When the apparatus 1 transmits data to the external receivers, the NCU 67 automatically calls the external receivers. Digital data indicative of the numbers of the external receivers are fed from the CPU 61 to the NCU 67.

The CPU 61, which is an arithmetic device, controls the various other elements of the control system connected thereto, according to various signals received and transmitted through the NCU 67, to implement data communication such as facsimile and telephone transmission and reception, and to control the printing device 71 to perform a recording operation on the paper sheet P according to recording information in the form of facsimile data (including image data) received through the telephone line 90, and printing data received from external personal computers and memory devices connected to the apparatus through the I/F 81.

The CPU 61 operates according to control program stored in the ROM 62, to control ejection of the ink droplets from the nozzles of the printing head 4, and detection of residual amounts and exhaustion of ink in the ink cartridges. The CPU 61 further operates to generate ink ejection timing signals and resetting signals and transmit the generated signals to gate arrays (not shown). The CPU 61 is connected to various devices included in the image-forming apparatus 1, and controls these devices.

The ROM 62 is a non-programmable memory storing the control programs executed by the CPU 61, and various fixed values. The ROM 62 incorporates a printing-start-position data table 62*a* storing, as the fixed values, printing-start-position data indicative of the printing start positions in the secondary scanning direction (in the sheet feeding direction A). The ROM 62 also stores, as one of the control programs, a control routine illustrated in the flow charts of FIGS. 6-8.

The printing-start-position data table 62*a* is a data table storing the printing start positions of the paper sheet P at which the printing operation on the paper sheet P is initiated by the printing device 71. Namely, the leading edge of the paper sheet P is located at the printing start position determined according to the data table, when the printing operation is initiated.

As described above, the present image-forming apparatus 1 is capable of performing the non-margin printing operation as well as the normal printing operation. The printing start position determined according to the printing-start-position data table 62*a* changes depending upon whether the normal printing operation or the non-margin printing operation is performed. Further, the printing start position of the leading edge of the paper sheet P initially set according to the printing-start-position data table 62*a* can be manually changed by an offset distance selected by the operator of the apparatus 1. The offset distance is a distance in the sheet feeding direction A between the leading edge of the paper sheet P set at the printing start position, and the position of the most downstream nozzle ($7^{th}$ nozzle) corresponding to the effective recording area G2.

When the leading edge of the paper sheet P on which the non-margin printing operation is to be performed is set at the initial printing start position determined according to the printing-start-position data table 62*a*, the leading edge is spaced apart from the position of the $7^{th}$ nozzle-by an initial offset distance of 2.5 mm in the upstream direction as seen in the sheet feeding direction A X-axis direction). The initial offset distance can be manually changed to a selected one of 1.0 mm, 0.5 mm and 0 mm, by the operator using the operator's control panel 14. In this case, the leading edge is spaced apart from the position of the $7^{th}$ nozzle by the offset distance of 1.0 mm, 0.5 mm and 0 mm in the upstream direction. The initial printing start position of the leading edge of the paper sheet P for the normal printing operation is spaced apart from the position of the $1^{st}$ nozzle in the downstream direction as seen in the sheet feeding direction A (X-axis direction).

The printing start position is represented by an amount of operation of the sheet feeding motor 79 required to feed the paper sheet P from the pressure nip between the two registering rollers 27 to the printing start position. The printing-start-position data table 62*a* stores the amount of operation of the sheet feeding motors 79 corresponding to the printing start position for the normal printing operation, and the amounts of rotation of the sheet feeding motors 79 corresponding to the respective four printing start positions for the non-margin printing operation. In the data table 62*a*, the amounts of rotation are stored in relation to the normal or non-margin printing operation, and in relation to the offset distances of the leading edge of the paper sheet P described above.

The RAM 63 is a volatile memory for temporarily storing various kinds of data used to execute the control programs stored in the ROM 62. The RAM 63 incorporates a carriage speed memory 63*a*, which is provided to store a moving speed of the carriage 5 each time the carriage 5 is moved.

Whenever a printing operation is performed by the present image-forming apparatus, the carriage 5 is moved by the carriage drive motor 25 at a speed of 40 ips (40 inches per second), which is represented by data (indicative of 40 ips) stored in the carriage speed memory 63*a*. In a bi-directional printing operation in which the printing operation is performed during both a rightward movement and a leftward or return movement of the carriage 5, the data "40 ips" are written in the carriage speed memory 63*a* for each of the rightward and leftward movements of the carriage 5. Namely, the carriage 5 is moved in the right and left directions at substantially the same speed (i.e., 40 ips).

The carriage 5 is moved at 4 ips during the leftward or return movement in the unidirectional non-margin printing operation. In this case, data "4 ips" are written in the carriage-speed memory 63*a*. Even in the unidirectional non-margin printing operation, data "40 ips" are written in the printing speed memory 63*a* for each of the rightward and return (leftward) movements of the carriage 5 after the leading edge of the paper sheet P has reached a position one inch ahead of the position of the 7th nozzle, that is, after the leading edge has moved one inch plus the offset distance from the printing start position. Accordingly, the carriage 5 is moved at 40 ips after the leading edge has moved one inch plus the offset distance.

The RAM 63 includes a memory area (buffer memory for storing received data) which is kept in its active state by a back-up power source and remains to store the data even when the RAM 63 is turned off. Accordingly, the data such as data received from an external facsimile transmitter through the telephone line 90 are kept stored in the RAM 63 even after power is removed from the RAM 63.

Referring next to FIG. 4, there will be described different configurations of printing operation performed by the present image-forming apparatus 1. As indicated in FIG. 4, the image-forming apparatus 1 is capable of performing the two types of printing operation, namely, the normal printing operation and the non-margin printing operation. The non-margin printing operation is performed in a selected one of a high-quality mode and a high-speed mode. The high-quality mode is selected when printing data (or facsimile data) received by the printing device 71 include a signal selecting the high-quality mode in which the printing operation is performed to assure a high quality of the printed image. When the high-quality mode is selected, it is desired to print the image with a relatively high quality than to perform the printing operation with relatively high efficiency, so that the printing operation in the high-quality mode is performed unidirectionally. In the unidirectional non-margin printing operation in the present image-forming apparatus 1, the printing operation on the paper sheet P is performed during only the rightward movement of the carriage 5 by the carriage drive motor 25, and the carriage 5 is returned leftwards without a printing operation. Although the printing speed is lower in the unidirectional printing operation than in the bidirectional printing operation, the quality of the printed image is higher in the unidirectional printing operation than in the bi-directional printing operation, since the unidirectional printing operation has a smaller amount of dislocation of image dots than the bidirectional printing operation.

The unidirectional non-margin printing operation in the high-quality mode is performed with a selected one of four different waiting times: 0 second; 1 second; 2 seconds; and 3 seconds. The waiting time is a length of time from a moment of termination of the rightward movement of the carriage 5 (printing head 4) to a moment of initiation of the return (leftward) movement of the carriage 5. When the waiting time of 0 second is selected, the return movement of the carriage 5 (printing head 4) is initiated when a time length of 20 mmsecs required to confirm the termination of the rightward movement of the carriage 5 has passed after the movement of termination of the rightward movement of the carriage 5. When the waiting times of 1 second, 2 seconds and 3 seconds are selected, the return movement of the carriage 5 is initiated when these waiting times have passed after the moment of termination of the rightward movement of the carriage 5. In the unidirectional non-margin printing operation in the high-quality mode, the return speed of the carriage 5 is 4 ips irrespective of the selected waiting time.

The high-speed mode is selected when the printing data or facsimile data received by the printing device 71 include a signal selecting the high-speed mode in which the printing operation is performed with relatively high efficiency. When the high-speed mode is selected, it is desired to perform the printing operation with relatively high efficiency than to print the image with a relatively high quality, so that the printing operation in the high-speed mode is performed bidirectionally. In the bidirectional printing operation, the printing operation on the paper sheet P is performed in not only the rightward movement of the carriage 5 but also the return or leftward movement of the carriage 5, so that the efficiency of the bi-directional printing operation is higher than that of the unidirectional printing operation.

Like the unidirectional non-margin printing operation in the high-quality mode, the bidirectional non-margin printing operation in the high-speed mode is also performed with a selected one of the four different waiting times: 0 second; 1 second, 2 seconds; and 3 seconds. In the bi-directional non-margin printing operation in the high-quality mode, however, the return speed of the carriage 5 is 40 ips.

A desired one of the four waiting times can be selected by operating the operator's control panel 14. The waiting time of 1 second is stored as an initial waiting time in a waiting-time memory 64*b* (which will be described). In the bi-directional normal printing operation in the highs-speed mode, the waiting time is fixed at 0 second, and the return speed is fixed at 40 ips.

Referring back to the block diagram of FIG. 5, the EEPROM 64 is a programmable non-volatile memory, which hold stored data even when the image-forming apparatus 1 is turned off. This EEPROM 64 includes an offset-distance memory 64*a*, the above-indicated waiting-time memory 64*b* and a return-speed memory 64*c*. The offset-distance memory 64*a* stores one of the offset distances 0 mm, 0.5 mm and 1.0 mm which is selected by operating the operator's control panel 14. Each time the presently selected offset distance is changed, the content of the offset-distance memory 64*a* is updated. The offset distance of 2.5 mm is stored as an initial offset distance in the offset-distance memory 64*a*.

The waiting-time memory 64*b* stores data representing one of the waiting times 0 second, 1 second, 2 seconds and 3 seconds which is selected by operating the operator's control panel 14. Each time the presently selected offset distance is changed, the content of the waiting-time memory 64*b* is updated. As indicated above, the waiting time of 1 second is stored as the initial waiting time in the waiting-time memory 64*b*.

Although the waiting-time memory 64*b* provided in the present embodiment stores the selected waiting time, the waiting-time memory 64*b* need not store the waiting time per se, but may store any form of information indicative of the selected waiting time, 0 second, 1 second, and 2 and 3 seconds. Where the waiting time is measured by a time counter, for example, the waiting-time memory 64*b* may store a count value indicative of the selected waiting time. Where only two waiting times (e.g., 1 second and 2 seconds) are selectively used, the waiting-time memory 64*b* may be a flag which is set to "0" to indicate one of the two waiting times and set to "1" to indicate the other waiting time.

The return-speed memory 64*c* is a memory for storing the above-described return speed of the carriage 5, namely, one of 4 ips and 40 ips which is selected by operating the operator's control panel 14. Each time the presently selected return speed is changed, the content of the return-speed memory 64*c* is updated. The return speed of 4 ips is stored as the initial return speed in the return-speed memory 64*c*.

The carriage 5 is returned (moved leftwards) at the return speed stored in the return-speed memory 64*c*, only when a predetermined pushbutton on the operator's control panel 14 is in the on state. When this pushbutton is in the on state, the CPU 61 reads out the return speed stored in the return-speed memory 64*c*, and sets the read-out return speed in the carriage-speed memory 63*a*, in step S25 of a sheet-feeding and carriage-movement control routine of FIG. 7 (which will be described). Where the return speed of 40 ips is stored in the return-speed memory 64*c* and the above-indicated pushbutton is in the on state, the carriage 5 is returned at 40 ips even while the unidirectional non-margin printing operation is performed on the leading end portion of the paper sheet P.

The return-speed memory 64*c* need not store the return speed per se, but may store any form of information indicative of a selected one of a plurality of return speeds of the carriage 5. In the present embodiment, the two return speeds (4 ips and 40 ips) are selectively available, so that the return-speed memory 64*c* may be a flag which is set to "0" to indicate one of those two return speeds and set to "1" to indicate the other return speed.

The CPU 61 refers to the above-described offset-distance memory 64*a* and waiting-time memory 64*b*, and also to the above-indicated return-speed memory 64*c*, if necessary, during the non-margin printing operation to control this non-margin printing operation according to the information stored in those memories 64*a*, 64*b*, 64*c*.

The clock circuit 66 is provided to measure a time, and includes a clock of a predetermined frequency, a frequency divider, and a counter which is incremented (within a predetermined range) each time a pulse generated by the frequency divider falls, for example. The time measured by the clock circuit 66 (i.e., the count of its counter) is read out by the CPU 61 for various processing operations.

The MODEM 68 is a modulator/demodulator which is connected to the NCU 67. The MODEM 68 is operable to convert analog data (including coded image data) received through the telephone circuit 90, into digital data, and convert digital data (including coded image data) of the image-forming apparatus 1 into analog data to be transmitted from the apparatus 1 through the telephone line 90. To this end, the MODEM 68 includes a modulating and demodulating mechanism, and a voice reproducing mechanism arranged to reproduce a voice from received analog voice data. The MODEM 68 is further operable to transmit and receive various data transmission control signals, and further includes a transmission buffer and a reception buffer for temporarily storing data during data transmission and reception to and from external receiver and transmitter.

The CODEC 69 is operable to code image data read by the scanner 70, and decode coded image data received through the telephone line 90. The decoded data (image data) are used by the printing device 71 to perform a printing operation on the paper sheet P.

The image memory 65 is a memory for storing bit data for the printing operation, and is constituted by a dynamic RAM (DRAM), which is an inexpensive large-capacity memory. The data (image data) which are decoded by the CODEC 65 are once stored in the image memory 65, and the image memory 65 is cleared after the decoded data stored in the image memory 65 are used by the printing device 71 to perform the printing operation on the paper sheet P. The image data read by the scanner 70 are also stored in the image memory 65, and the image memory 65 is cleared after the image data are coded by the CODEC 65 and transmitted from the image-forming apparatus 1 through the telephone line 90.

The printing device 71 is arranged to perform a recording or printing operation on the paper sheet P supplied from the sheet supply cassette 3 installed in the image-forming apparatus 1. The printing device 71 includes: the above-described sheet sensor 72, carriage-home-position sensor 73, printing head 4, carriage drive motor 25, sheet supply motor 77 and sheet feeding motor 79; a head driver 75 for driving the printing head 4; a carriage-motor driver 76 for driving the carriage drive motor 25; a sheet-supply-motor driver 78 for driving the sheet supply motor 77; and a feeding-motor driver 80 for driving the sheet feeding motor 79.

The head driver 75 is a driver circuit arranged to apply drive pulses to drive elements for the respective nozzles, according to output signals of the gate arrays (not shown), such that the drive pulses have waveforms corresponding to the output signals. The drive elements are activated to eject ink droplets from the corresponding nozzles.

The carriage-motor driver 76, sheet-supply-motor driver 78 and sheet-feeding-motor driver 80 are connected to the carriage drive motor 25, sheet supply motor 77 and sheet feeding motor 79, respectively, and arranged to apply drive voltages to those motors 25, 77, 79. The drivers 76, 78, 80 control the amounts of rotation of the corresponding motors 25, 77, 79 (DC motors), by regulating the time durations of the voltage application to the motors 25, 77, 79.

The interface 81 (I/F) is a device for connecting the image-forming apparatus 1 to various external devices (e.g., personal computers and local area network (LAN)) having different electrical connection standards, so that the image-forming apparatus 1 effects transmission and reception of data (reception of printing data) to and from the personal computers and LAN through the I/F 81. The received printing data are converted into image data in the form of bit data, which are stored in the image memory 65. The external-memory receptacle 11 (shown in FIG. 1) is a connector for connecting an external memory to the CPU 61 through the bus line.

The present image-forming apparatus 1 is designed to minimize the ejected ink droplets for the purpose of improving the quality of an image formed by the ink droplets. In the present embodiment, the volume of each ink droplet normally ejected from each nozzle is 2 picoliter. For assuring a high-quality image, it is important to reduce a distance between the nozzles and the recording surface of the paper sheet P. If the distance is excessively large, the ink droplet is less likely to reach the recording surface, and tends to change into a spray mist which floats in a space between the nozzle and the recording surface, causing contamination of the recording surface with the spray mist. It is also noted that the non-margin printing operation is performed such that the ink droplets are ejected also from the nozzles ahead of and behind the respective leading and trailing edges of the paper sheet P. To prevent contamination of the back surface of the paper sheet P with the ink droplets ejected onto the platen 26, the platen 26 is formed with the above-described step-down plate 43 so that the effective recording area G2 in which the nozzles are ejected to perform the non-margin printing operation is provided over the upper surface of the step-down plate 43.

Since the distance from the upper surface of the step-down plate 43 to the nozzle surface of the printing head 4 is larger than the distance from the upper surface of the top plate 40 to the nozzle surface, the ink droplets ejected onto portions of the step-down plate 43 which are ahead of and behind the respective leading and trailing edges of the paper sheet P are more like to change into a spray mist. To reduce a risk of contamination of the back surface of the paper sheet P with the spray mist, the present image-forming apparatus 1 is arranged to adjust the above-described offset distance, waiting time and return speed.

Figures 9A, 9B:
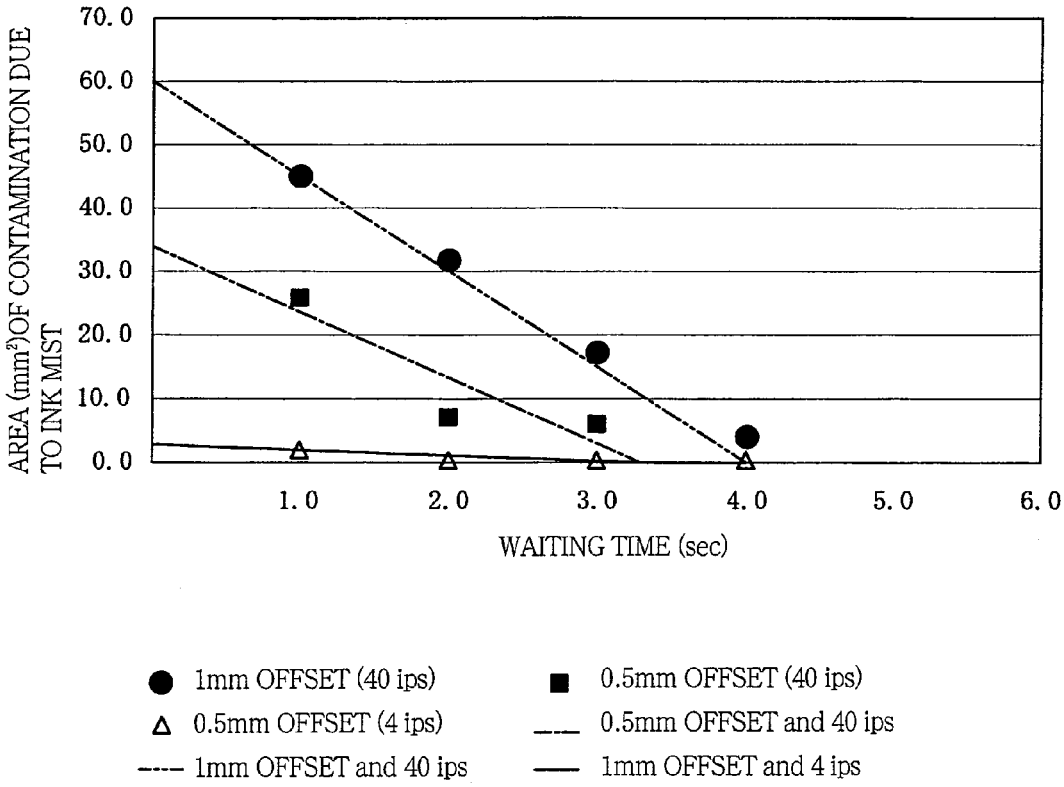
FIGS. 9A and 9B are views indicating a relationship among an offset distance, a waiting time, a return speed and a surface area of contamination of the back surface of a paper sheet with ink.

Referring to FIGS. 9A and 9B, there will be described a relationship among the degree of contamination of the back surface of the paper sheet P with ink, the offset distance, the waiting time and the return speed. FIG. 9A is a table indicating the relationship between the degree of contamination, and different combinations of the offset distance, waiting time and return speed, while FIG. 9B is a graph indicating the relationship.

The leftmost column of the table of FIG. 9A indicates the offset distance of 1.0 mm where the return speed is 40 ips, the offset distance of 0.5 mm where the return speed is 40 ips, and the offset distance of 0.5 mm where the return speed is 4 ips. The four columns to the right of the leftmost column indicate the areas of contamination for the different combinations of the offset distances (1 mm and 0.5 mm) and the waiting times (1 second, and 2, 3 and 4 seconds).

In the graph of FIG. 9B, the waiting time (sec) is taken along the abscissa, while an area of contamination of the back surface of the paper sheet P with the ink mist is taken along the ordinate. While triangles in the graph represent the areas of contamination where the offset distance is 0.5 mm and the return speed is 4 ips, and a solid line connecting these white triangles indicates a change of the area of contamination with a change of the waiting time.

Black circles in the graph of FIG. 9B represent the area of contamination where the offset distance is 1.0 mm and the return speed is 40 ips, and a two-dot chain line connecting these black circles indicate a change of the area of contamination with the change of the waiting time. Black squares represent the area of contamination where the offset distance is 0.5 mm and the return speed is 40 ips, and a one-dot chain line connecting these black squares indicate a change of the area of contamination with the change of the waiting time.

FIGS. 9A and 9B indicate a tendency that the area of contamination of the back surface of the paper sheet P with the ink decreases with a decrease of the offset distance (a decrease of the amount of ink ejected ahead of the leading edge of the paper sheet P). It will therefore be understood that the area of contamination can be effectively reduced by reducing the offset distance between the leading edge of the paper sheet P at the printing start position and the position of the $7^{th}$ nozzle in the sheet feeding direction A (X-axis direction). In the image-forming apparatus 1, the offset distance can be changed by the operator using the operator's control panel 14.

FIGS. 9 and 10 also indicate a tendency that the area of contamination decreases with an increase of the waiting time between the moment of termination of the rightward movement of the carriage 5 and the moment of initiation of the return or leftward movement of the carriage 5. In a conventional image-forming apparatus, the return movement of the carriage is initiated immediately (e.g., 20 mmsec) after the moment of confirmation of the termination of the rightward movement of the carriage, even in the case of the non-margin printing operation, as well as in the case of the normal printing operation. It will therefore be understood that the area of contamination can be effectively reduced by reducing the waiting time before initiation of the return movement of the carriage 5. In the image-forming apparatus 1, the waiting time can be changed by the operator using the operator's control panel 14.

FIGS. 9A and 9B further indicate a tendency that the area of contamination decreases with a decrease of the return speed of the carriage 5. It will therefore be understood that the area of contamination can be effectively reduced by reducing the return speed. In the image-forming apparatus, 1, the return speed can be changed by the operator using the operator's control panel 14.

Figure 6:
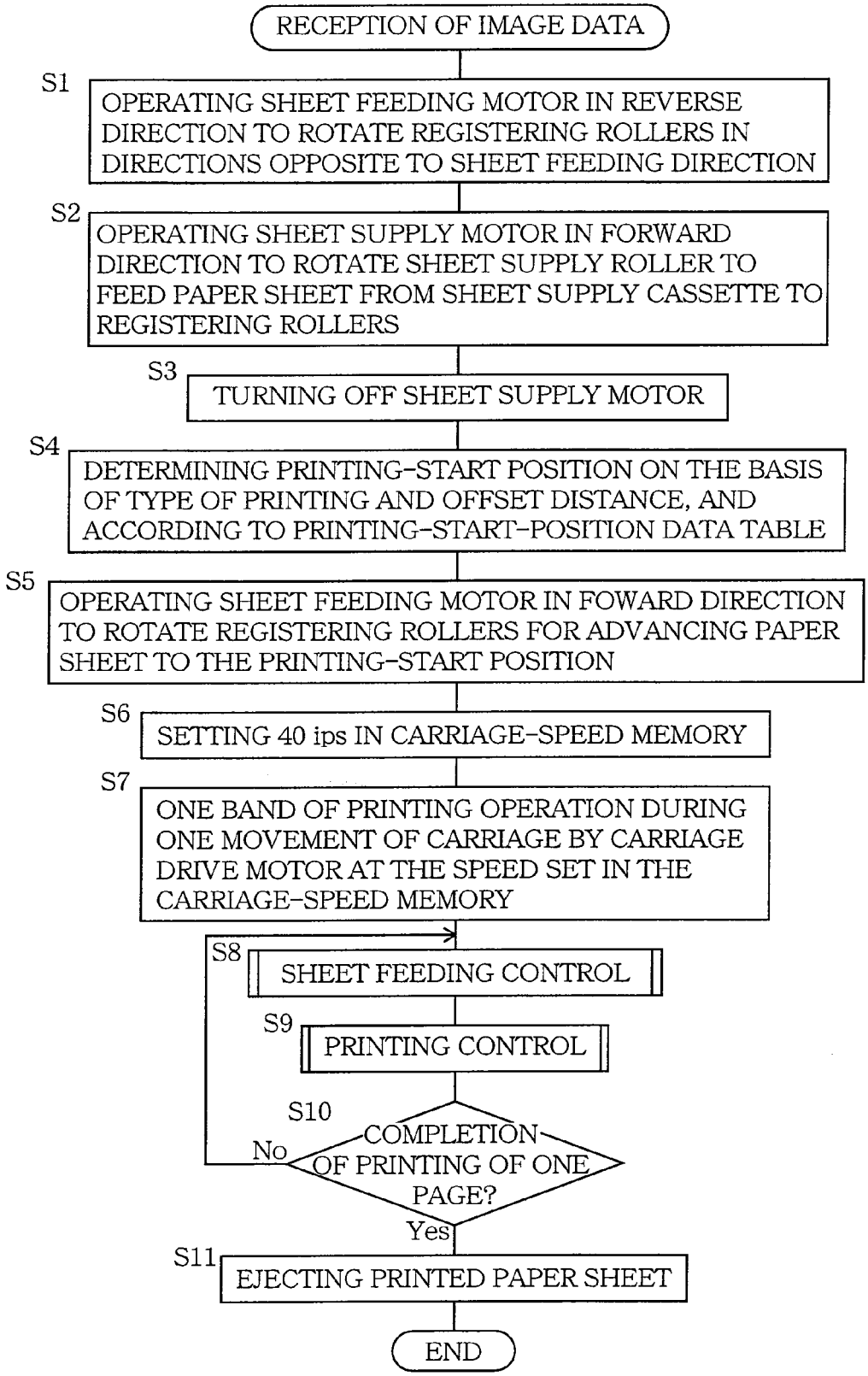
FIG. 6 is a flow chart illustrating a control routine executed by the control system.

Referring to the flow charts of FIGS. 6-8, there will be described various processing operations performed by the present image-forming apparatus 1. The flow chart of FIG. 6 illustrates a control routine, which includes step S8 to execute a sheet-feeding and carriage-movement control routine illustrated in the flow chart of FIG. 7, and step S9 to execute a printing control routine illustrated in the flow chart of FIG. 8. The image-forming apparatus 1 is arranged to start the control routine of FIG. 6 when the apparatus 1 receives image data (facsimile data) through the telephone line 90, or printing data from an external personal computer through the I/F 91, or a printing command which is generated by operation of the operator's control panel 14, to request printing of data stored in the external memory inserted in the external-memory receptacle 11.

The control routine of FIG. 6 is initiated with step S1 to operate the sheet feeding motor 79 in the reverse direction for rotating the registering rollers 27 in the reverse directions opposite to the sheet feeding direction A. Then, step S2 is implemented to operate the sheet supply motor 77 by a predetermined amount to rotate the sheet supply roller 6. As a result, the uppermost paper sheet P of the sheet stack accommodated in the sheet supply cassette 3, or the paper sheet P placed on the auxiliary sheet support 3*a* is fed from the sheet supply cassette 3 and advanced along the U-turn path 9 until the leading edge of the paper sheet P reaches the nip of the registering rollers 27 rotating in the reverse directions.

The ROM 62 stores data indicative of a predetermined amount of operation of the sheet supply motor 77 required to rotate the sheet supply roller 6 for advancing the paper sheet P along the U-turn path 9 to the nip of the registering rollers 27. The amount of rotation of the sheet supply roller 6 required to feed the paper sheet P from the sheet supply cassette 3 by a distance corresponding to the known length of the U-turn path 9 is known. A predetermined amount of rotation of the sheet supply roller 6 is added to this known amount of rotation to obtain the amount of rotation of the sheet supply roller 6 required to advance the paper sheet P to the registering rollers 27. When the leading edge of the paper sheet P has reached the nip of the registering rollers 27, these registering rollers 27 are rotated in the reverse directions, so that the paper sheet P is prevented from being further advanced from the nip of the registering rollers 27, with the leading edge of the paper sheet P held in contact with the nip, whereby the paper sheet P is registered such that the leading edge is made parallel to the main scanning direction (Y-axis direction).

Then, the control flow goes to step S3 to turn off the sheet supply motor 77, and to step S4 to determine the printing-start-position of the leading edge of the paper sheet, depending upon the type of printing (namely, whether the normal printing operation or the non-margin printing operation is to be performed), and on the basis of the offset distance stored in the offset-distance memory 64*a* and according to the printing-start-position data table 62*a*. As described above, the printing start position changes depending upon whether the normal printing operation or the non-margin printing operation is performed on the paper sheet P. In the case of the non-margin printing operation, the initial printing start position may be changed by the operator by selecting the desired offset distance. The image data or printing data received by the image-forming apparatus 1 include a command indicating whether the non-margin printing operation is to be performed according to the received image data or printing data, without the top and bottom margins left on the paper sheet P. In the case of the non-margin printing operation, the operator can select the desired offset distance. While the initial offset distance of 2.5 mm is stored in the offset-distance memory 64*a*, the content of this memory 64*a* is updated each time the offset distance is manually selected by the operator. In the case of the non-margin printing operation, therefore, the printing start position of the leading edge of the paper sheet P is determined on the basis of the offset distance read out from the offset-distance memory 64*a*, and according to the printing-start-position data table 62*a*.

The control flow then goes to step S5 to operate the sheet feeding motor 79 in the forward direction for rotating the registering rollers in the forward directions for advancing the paper sheet P in the sheet feeding direction A until the leading edge of the paper sheet P reaches the determined printing start position. The printing-start-position data table 62*a* stores the different amounts of operation of the sheet feeding motor 79 required to advance the paper sheet P from the nip of the registering rollers 27 to the respective printing start positions. Accordingly, the paper sheet P is advanced to the determined printing start position, by operating the sheet feeding motor 79 by the amount of operation of this motor 79 read out from the data table 62*a*. The control flow then goes to step S6 is implemented to set the return speed of 40 ips in the return-speed memory 63*a*. In the following step S7, one band of printing operation is performed by the printing head 4 while the carriage 5 is moved in one direction by the carriage drive motor 25 at the speed set in the carriage-speed memory 63*a*. The "one band" of printing operation is a printing operation during one movement of the carriage 5 in a predetermined area the X-axis dimension of which is determined by the number of the used nozzles arranged in each row extending in the X-axis direction. In the unilateral printing operation, the one band of printing operation is performed during the rightward movement of the carriage 5. In the bi-directional printing operation, the one band of printing operation is performed during each of the rightward and leftward movements of the carriage 5.

In a terminal portion of the one band of printing operation by the printing head 4, the CPU 61 commands the carriage-motor driver 76 to decelerate the carriage drive motor 25, for decelerating the carriage 5 before the carriage 5 is stopped. The position at which the carriage 5 is stopped is detected by the encoder strip described above. Where the printing data (bit data) require the one band of printing operation to be terminated at a position inwardly of the right or left edge of the paper sheet P in the direction of the width of the paper sheet P (in the main scanning direction), the carriage 5 may be stopped at that position of termination of the one band of printing operation. Alternatively, the carriage 5 may be stopped after each one band of printing operation, at a predetermined position which is outside the width of the paper sheet P, irrespective of the position at which the one band of operation is actually terminated according to the printing data.

Then, the control flow goes to step S8 to execute the sheet-feeding and carriage-movement control routine for controlling the feeding of the paper sheet P in the sheet feeding direction A, and to step S9 to execute the printing control routine for controlling the printing operation on the paper sheet P by the printing head 4. Step S9 is followed by step S10 to determine whether one page of printing operation is completed. If a negative decision (No) is obtained in step S10, the control flow goes back to step S8. Steps S8 and S9 are repeatedly implemented until one page of printing operation is completed (until the printing operation on the paper sheet P in question is completed). If an affirmative decision (Yes) is obtained in step S10, the control flow goes to step S11 to operate the sheet feeding motor 79 to rotate the ejector roller 28*b* at a higher speed, for rapid ejection of the paper sheet P, whereby the control routine of FIG. 6 is terminated.

Figure 7:
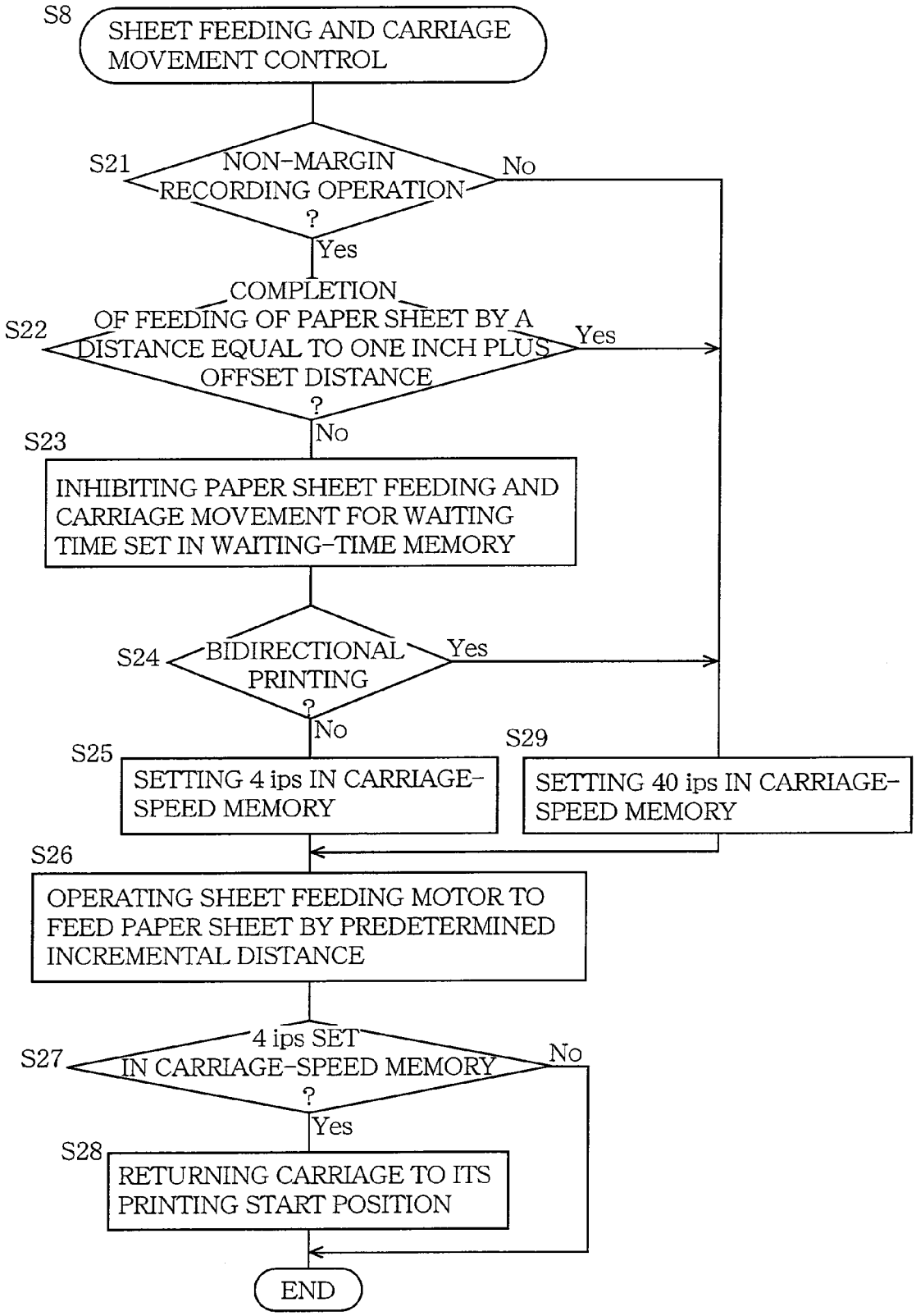
FIG. 7 is a flow chart illustrating a sheet-feeding and carriage-movement control routine executed in step S8 of the control routine of FIG. 6.

The control routine of step S8, which is illustrated in the flow chart of FIG. 7, is initiated with step S21 to determine whether the non-margin printing operation is requested according to the received recording information or data. This determination is made depending upon whether the received recording information includes a non-margin-printing signal requesting the non-margin printing operation. If an affirmative decision (Yes) is obtained in step S21, the control flow goes to step S22 to determine whether the paper sheet P has been advanced from the printing start position by a distance equal to one inch plus the offset distance stored in the offset distance memory 64*a*.

In the present embodiment, the movement of the carriage 5 in the non-margin printing operation is controlled in a special manner, for a predetermined special control length of one inch from the leading edge of the paper sheet P in the upstream direction as seen in the sheet feeding direction A Namely, the movement of the carriage 5 is controlled in the special manner suitable for the non-margin printing operation, while the non-printing operation is performed in the leading end portion of the paper sheet P, which has the length of one inch from the leading edge in the sheet feeding direction A. Where the initial offset distance of 2.5 mm is stored in the offset-distance memory 64*a*, that is, where the printing start position of the leading edge of the paper sheet P is spaced 2.5 mm from the position of the most downstream $7^{th}$ nozzle in the effective recording area G2, the control of the carriage movement in the special manner is terminated when the paper sheet P has been advanced from the printing start position by a distance equal to one inch plus 2.5 mm. Where the offset distance of 1.0 mm is stored in the offset-distance memory 64*a*, the printing start position of the leading edge of the paper sheet P is located 1.5 mm ahead of the printing start position where the initial offset distance of 2.5 mm is stored in the offset-distance memory 64*a*. In this case, the control of the carriage movement in the special manner is terminated when the paper sheet P has been advanced from the printing start position by a distance equal to one inch plus 1.0 mm. Similarly, the control of the carriage movement in the special manner is terminated when the paper sheet P has been advanced from the printing start position by a distance equal to one inch and 0.5 mm and a distance equal to one inch plus 0 mm, where the offset distances of 0.5 mm and 0 mm are stored in the offset-distance memory 64*a*. Step S22 is provided to determine whether the special control of the carriage movement should be terminated or not. The above-described special control length corresponds to the leading end portion of the paper sheet P for which the carriage movement is controlled in the special manner in the non-margin printing operation. Where the paper sheet P is a postcard having a front surface on which the non-printing operation is to be performed and a back surface on which the address of a receiver is written or printed, the top end portion of the back surface of the postcard which is the leading end portion of the paper sheet P includes a part in which a postal area code is written or printed. Since the carriage movement is controlled in the special manner for the top end portion of the postcard, the postal area code part is protected from contamination with an ink mist.

When a negative decision (No) is obtained in step S22, that is, when the paper sheet P has not been advanced from the printing start position by the distance equal to one inch plus the offset distance stored in the offset-distance memory 64*a*, the control flow goes to step S23 to inhibit the following steps S24-S28 from being implemented for the waiting time stored in the waiting-time memory 64*b*, on the basis of the time measured by the clock circuit 66, so that the movement of the carriage 5 is inhibited for the waiting time. Namely, step S23 is provided for the CPU 61 to inhibit the movement of the carriage 5 after stopping of the carriage 5, until the time measured by the clock circuit 66 becomes equal to the waiting time stored in the waiting-time memory 64*b*.

Where the initial waiting time of 1 second stored in the waiting-time memory 64*b* remains unchanged without an operation of the operator's control panel 14 to change the waiting time, the movement of the carriage 5 is inhibited for the waiting time of 1 second. Where the waiting time stored in the waiting-time memory 64*b* is changed to 2 or 3 seconds, the movement of the carriage 5 is inhibited for the waiting time of 2 or 3 seconds. Where the waiting time stored in the waiting-time memory 64*b* is changed to 0 second, the control flow goes to step S24 immediately after step S23.

Step S24 is provided to determine whether the bidirectional non-margin printing operation (in the high-speed mode) is requested. If a negative decision (No) is obtained in step S24, that is, if the unidirectional non-margin printing operation (n the high-quality mode) is requested, the control flow goes to step S25 to set 4 ips in the carriage-speed memory 63*a*, and to step S26 to operate the sheet feeding motor 79 to feed the paper sheet P by the predetermined incremental distance. Step S26 is followed by step S27 to determine whether 4 ips is set in the carriage-speed memory 63*a*. If an affirmative decision (Yes) is obtained in step S27, the control flow goes to step S28 to return the carriage 5 to its printing start position at the speed of 4 ips, whereby the sheet-feeding and carriage-movement control routine of step S8 is terminated. In the printing control routine in step S9, the unidirectional non-margin printing operation by the printing head 4 is performed during the next rightward movement of the carriage 5.

The printing start position of the carriage 5 is a position in the main scanning direction at which the rightward movement of the carriage 5 is started in the unidirectional printing operation to perform one band of printing operation. In the bidirectional printing operation, there are two printing start positions at which the rightward and leftward movements of the carriage 5 are started, each for effecting one band of printing operation.

Thus, the unidirectional non-margin printing operation is performed such that the carriage which has been moved rightwards to effect one band of printing operation is returned leftwards at a relatively low speed of 4 ips only after the selected waiting time has passed after the moment of termination of the rightward movement. This arrangement is effective to reduce the area of contamination of the back surface of the leading end portion of the paper sheet P with the ink mist.

If a negative decision (No) is obtained in step S21, that is, if the normal printing operation is requested, the ink droplets ejected from the nozzles are all received by the paper sheet P, and there is not a risk of contamination of the back surface of the paper sheet P with the ink mist. In this case, the control flow goes to step S29 to set 40 ips in the carriage-speed memory 63*a*. This step S29 is followed by the step S26 described above. Accordingly, the steps S23-S25 including the step S23 to inhibit the movement of the carriage 5 for the selected waiting time are skipped when the normal printing operation is performed.

If an affirmative decision (Yes) is obtained in step S22, that is, if the paper sheet P has been advanced from the printing start position by the distance equal to one inch plus the offset distance stored in the offset-distance memory 64*a*, the special control of movement of the carriage 5 is terminated in the non-margin printing operation, for the predetermined special control length of one inch from the leading edge of the paper sheet P. In this case, the control flow goes to the above-described step S29. Accordingly, the carriage 5 is moved rightwards at 40 ips, and the return or leftward movement of the carriage 5 at 40 ips is initiated without the waiting time (with the waiting time of 0 second).

In the non-margin printing operation, the ink droplets are ejected also by the nozzles located behind the trailing edge of the paper sheet P, as well as the nozzles located ahead of the leading edge of the paper sheet P. Therefore, an ink mist may be generated also by the ink droplets ejected by the nozzles located behind the trailing edge of the paper sheet P. However, the trailing edge of the paper sheet P is moved away from the location of generation of the ink mist (namely, away from the step-down plate 43), so that the trailing end portion of the paper sheet P is not likely to be contaminated with the ink mist, unlike the leading end portion. For this reason, the special control of movement of the carriage 5 is applied to only the leading end portion of the paper sheet P which has the length of one inch from the leading edge in the sheet feeding direction A.

After the leading edge of the paper sheet P has moved ahead of the position of the most downstream $7^{th}$ nozzle in the effective recording area G2 in the downstream direction as seen in the sheet feeding direction A, the ink droplets ejected from the nozzles are received by the paper sheet P and do not change into a spray mist, so that there is not a risk of contamination of the back surface of the leading end portion of the paper sheet P with the ink mist. In this respect, the special control length from the leading edge of the paper sheet P is not limited to one-inch, but may be a shorter than one inch, for example, 1.0 mm. In this case, the special control of movement of the carriage 5 is terminated when the paper sheet P has been advanced from the printing start position by the distance equal to 1.0 mm and the selected offset distance (from the position of the $7^{th}$ nozzle to the printing start position).

If an affirmative decision (Yes) is obtained in step S24, that is, if the bi-directional non-margin printing operation (in the high-speed mode) is requested, the control flow goes to the above-described step S29 in which 40 ips set in the carriage-speed memory 63*a*.

There are various kinds of printed matters, some of which are not required to have a high-quality image but are required to be produced with high efficiency. It is also noted that some kinds of printed matters are required to be protected from contamination with ink in its leading end portion, while some other kinds of printed matters are not so required. As indicated above, a postcard whose front surface is subjected to the non-margin printing operation is required to be protected from contamination with ink in the leading end portion of its back surface, which includes the postal area code part the ink contamination of which causes a serious problem that a code reader fails to read the postal area code. Some kinds of printed matters are required to be produced with high efficiency, rather than to have a high-quality image.

In view of the various requirements associated with the printed matters to be produced, the present image-forming apparatus 1 permits the operator to select the desired offset distance and waiting time, and if necessary, the desired return speed of the carriage 5, depending upon the kind or requirements of the printed matter to be produced, so that the printed matter is produced so as to satisfy the requirements.

Figure 8:
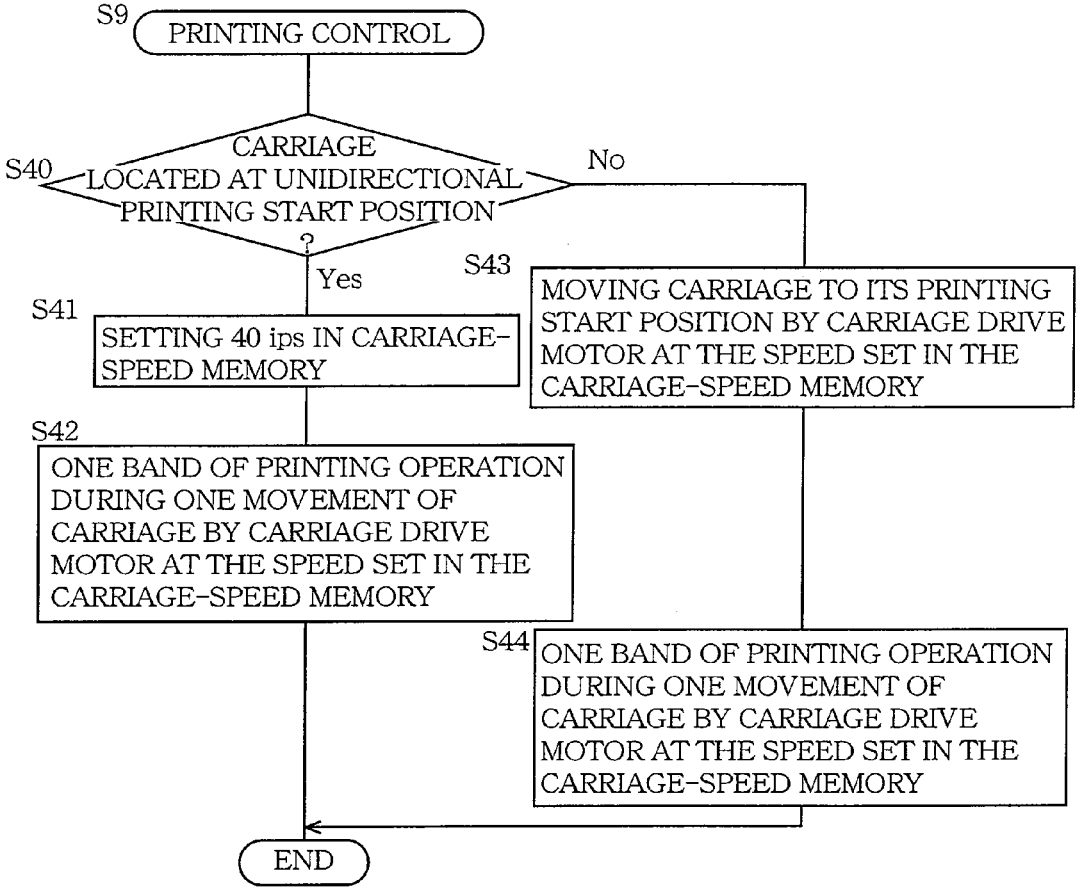
FIG. 8 is a flow chart illustrating a printing control routine executed in step S9 of the control routine of FIG. 6.

The printing control routine of step S9, which is illustrated in the flow chart of FIG. 8 is initiated with step S40 to determine whether the carriage 5 has been returned to the printing start position at which the rightward movement of the carriage 5 is initiated to perform one band of printing operation in the unidirectional non-margin printing operation. If an affirmative decision (Yes) is obtained in step S40, the control flow goes to step S41 to set 40 ips in the carriage-speed memory 63*a*, and to step S42 to operate the carriage drive motor 25 for moving the carriage 5 at the speed (40 ips) set in the carriage-speed memory 63*a*, to perform one band of printing operation, whereby the printing control routine of FIG. 9 is terminated.

If a negative decision (No) is obtained in step S40, this means that the carriage 5 must be returned to the printing start position at which the rightward or leftward movement of the carriage 5 is started. In this case, the control flow goes to step S43 to operate the carriage drive motor 25 for moving the carriage 5 to the printing start position at the speed set in the carriage-speed memory 63*a*. If the next one band of printing operation is to be performed with the leftward movement of the carriage 5 in the bi-directional printing operation, the carriage 5 is moved to the printing start position at which the leftward movement is initiated. If the next one band of printing operation is to be performed with the rightward movement of the carriage 5, the carriage 5 is moved to the printing start position at which the rightward movement is initiated. Step S43 is followed by step S44 to operate the carriage drive motor 25 to move the carriage 5 at the speed stored in the carriage-speed memory 63*a*, for effecting one band of printing operation, whereby the printing control routine of FIG. 9 is terminated. In the case of the directional printing operation, and after termination of the unidirectional non-margin printing operation for the leading end portion of the paper sheet P which has the predetermined special control length from the leading edge, the carriage speed of 40 ips is necessarily stored in the carriage-speed memory 63*a*, so that the carriage 5 is moved in the rightward and leftward directions at the same speed (40 ips), in the bidirectional printing operation, permitting a high degree of stability of the bidirectional printing operation.

The printing control routine of step S9 is arranged such that although the speed of the leftward or return movement of the carriage 5 in the unidirectional non-margin printing operation is set to be 4 ips, the speed of movement of the rightward movement of the carriage 5 to perform one band of printing operation is set to be 40 ips as in the normal printing operation, so that the overall non-margin printing efficiency of the image-forming apparatus 1 is not so lowered due to the reduction of the return speed of the carriage 5 for reducing the area of ink contamination of the back surface of the paper sheet P.

In the present image-forming apparatus 1 constructed and arranged as described above, the waiting time between the moment of termination of the rightward movement of the carriage 5 to effect the printing operation by the printing head 4 and the moment of initiation of the leftward or return movement of the carriage 5 can be made longer than in the conventional image-forming apparatus, and the speed of the leftward or return movement of the carriage 5 can be made lower than in the conventional image-forming apparatus. Accordingly, the risk of contamination of the back surface of the leading end portion of the paper sheet P with the ink mist can be reduced. Further, the waiting time and the return speed of the carriage 5 can be changed as desired by the operator by operating the operator's control panel 14, so that the conditions of the printing operation can be manually adjusted by the operator.

It will be understood that a portion of the control system assigned to execute the sheet-feeding and carriage-movement control routine illustrated in the flow chart of FIG. 7 functions as a waiting-time control device, and a carriage-speed control portion. The waiting-time control portion is operable in the non-margin printing operation of the image-forming apparatus, to provide a waiting time between the moment of termination of a movement of the carriage 5 in one of opposite directions and the moment of initiation of a subsequent movement of the carriage 5 in the other of the opposite directions, if the non-margin printing operation by the printing head 4 is performed during the movement of the carriage 5 in the above-indicated one direction. The carriage-speed control portion is operable in the non-margin recording operation, to control a driving device in the form of the carriage drive motor such that after the carriage 5 is moved in one of the opposite directions parallel to the main scanning direction while the non-margin recording operation is performed by the printing head 4, the carriage 5 is moved in the other of the opposite directions at a lower speed which is lower than that of the movement of the carriage 5 in the above-indicated one of the opposite directions. It will also be understood that a portion of the control system assigned to implement steps S40-S42 of the printing control routine of FIG. 8 functions as the waiting-time control device which is further arranged to move the carriage 5 in the above-indicated other direction without the waiting time, if the printing operation by the printing head 4 is not performed during the movement of the carriage 5 in the above-indicted one direction. It will further be understood that a portion of the control system assigned to implement step S21 of the control routine of FIG. 7 functions as a judging portion operable to determine whether the recording information which has been received by a recording-information receiving device (65, 67-70, 81, 90) and which includes recording data for recording an image of the paper sheet P includes a non-margin-recording signal requesting the non-margin printing operation.

In the illustrated embodiment wherein the non-margin printing operation by the printing head 4 is performed without the top margin left along the leading edge of the paper sheet P, the waiting time is provided only while the non-margin printing operation is performed in the leading end portion of the paper sheet P which has the predetermined special control length (e.g., one inch) from the leading edge in the secondary scanning direction (X-axis direction). In other words, the waiting time is not provided while the non-margin printing operation is performed in the other portion of the paper sheet P. Accordingly, the image-forming apparatus 1 of the illustrated embodiment minimizes the reduction of the overall non-margin printing efficiency of the paper sheet P (that is, an increase of the required overall printing time of the paper sheet P), while reducing the risk of contamination of the paper sheet P with the ink mist.

An ink mist is also generated when the non-margin printing operation is performed without the bottom margin left along the training edge of the paper sheet P, or without the right or left margin left along the right or left edge of the paper sheet P. However, the ink mist generated during the non-margin printing operation in the trailing end portion of the paper sheet P is less likely to cause the contamination of the trailing end portion with the ink mist, since the trailing end portion is moved away from the space in which the ink mist is generated. During the non-margin printing operation in the side edge portion of the paper sheet P, the amount of ink mist generated is considerably smaller than that during the non-margin printing operation in the leading end portion, since the number of the used nozzles located outside the right or left edge of the paper sheet P is comparatively small, and since the paper sheet P is not fed in the main scanning direction, that is, not fed into the area of generation of the ink mist which is originally located outside the right or left edge of the paper sheet P. Accordingly, the ink mist generated during the non-margin printing operation in the side edge portion of the paper sheet P is less like to cause the contamination of the side edge portion with the ink mist Therefore, the provision of the above-described waiting time only while the non-margin printing operation is performed in the leading end portion of the paper sheet P is effective to reduce the contamination of the paper sheet P with the ink mist while preventing the provision of the waiting time during the non-margin printing operation in the trailing end or side edge portion of the paper sheet P, thereby minimizing the reduction of the overall non-printing efficiency of the paper sheet P.

Further, the apparatus 1 in the illustrated embodiment is further arranged such that the carriage 5 is returned to the printing start position at the lower speed only while the non-margin printing operation is performed in the leading end portion of the paper sheet P. This arrangement provides substantially the same advantages described above with respect to the waiting time provided only while the non-margin printing operation is performed in the leading end portion of the paper sheet P.

In the illustrated embodiment, only the leftward or return movement of the carriage 5 followed by the rightward movement in the unidirectional non-margin printing operation is inhibited for the predetermined waiting time after the movement of termination of the rightward movement. In other words, if the non-margin printing operation is not performed during the rightward movement of the carriage 5, the waiting time is not provided before the subsequent leftward movement of the carriage 5. This arrangement is also effective to reduce the risk of contamination of the paper sheet P with the ink while preventing the unnecessary provision of the waiting time to minimize the required overall printing time and the overall printing efficiency.

In the illustrated embodiment, the carriage 5 is moved at the same speed of 40 ips in both of the rightward and leftward directions during the bi-directional non-margin printing operation, so that the bi-directional non-margin printing operation can be performed with high efficiency. If the rightward and leftward movements of the carriage 5 in the bi-directional non-margin printing operation were effected at respective different speeds, it would be difficult to control the carriage drive motor 25.

In the illustrated embodiment, a time-measuring device in the form of the clock circuit 66 is provided to measure a time which has passed after the movement of termination of the rightward movement of the carriage 5, and a time memory in the form of the waiting-time memory 64*b* is provided to store data representing the predetermined waiting time. The carriage drive motor 25 is controlled such that the leftward movement of the carriage 5 to the printing start position is initiated when the time measured by the clock circuit 66 has exceeded the predetermined waiting time represented by the data stored in the waiting-time memory 64*b*.

Generally, it is desirable to perform a recording or printing operation with high efficiency or at a high speed, while assuring high quality of a printed image. Although the provision of the waiting time prior to the leftward movement of the carriage 5 to the printing start position is effective to reduce the risk of contamination of the paper sheet P with the ink and improve the quality of the printed image, an unnecessarily large length of the waiting time is not desirable for minimizing the required overall recording time. Accordingly, the suitable waiting time is determined to provide a compromise between the requirement for preventing the ink contamination of the paper sheet P and the requirement for minimizing the required recording time. In this respect, it is important to accurately measure the determined waiting time. To this end, the clock circuit 66 and the waiting-time memory 64*b* are used to accurately control the waiting time that should be provided before the carriage 5 is returned to the printing start position in the unidirectional non-margin printing operation.

In the illustrated embodiment, a time input device in the form of the operator's control panel 14 is provided to manually input the data representing the desired waiting time, which are stored in the time memory in the form of the waiting-time memory 64*b*. The carriage 5 is returned to the printings start position when the time measured by the clock circuit 66 has exceeded the waiting time represented by the data stored in the waiting-time memory 64*b*. Thus, the return movement of the carriage 5 can be inhibited for the desired waiting time which is manually input by the operator through the operator's control panel 14. In other words, the waiting time can be determined by the operator, depending upon the operator's desires relating to the quality of the printed image and the printing time or efficiency for each of various kinds of printed matters to be reproduced by the image-forming apparatus 1. The present arrangement prevents an unnecessarily high degree of quality of the printed image where the operator desires a relatively high degree of printing efficiency rather than the high degree of quality of the printed image, or prevents an unsatisfactory quality of the printed image due to a relatively high degree of printing efficiency where the operator desires a high degree of quality of the printed image.

In the illustrated embodiment, a speed input device in the form of the operator's control panel 14 is provided to manually input data representing the speed at which the carriage 5 is moved in the leftward direction in the unidirectional non-margin printing operation, and a speed memory in the form of the return-speed memory 64*c* is provided to store the data manually input through the speed input device. In the non-margin printing operation, the carriage drive motor 25 is controlled to move the carriage 5 in the leftward direction at the speed represented by the data stored in the return-speed memory 64*c*. In other words, the speed of the leftward or return movement of the carriage 5 to the printing start position in the unidirectional non-margin printing operation can be determined by the operator, depending upon the operator's desires relating to the quality of the printed image and the printing time or efficiency for each of various kinds of printed matters to be reproduced by the image-forming apparatus 1. The present arrangement prevents an unnecessarily high degree of quality of the printed image where the operator desires a relatively high degree of printing efficiency rather than the high degree of quality of the printed image, or prevents an unsatisfactory quality of the printed image due to a relatively high degree of printing efficiency where the operator desires a high degree of quality of the printed image.

In the illustrated embodiment, the feeding movement of the paper sheet P by a medium feeding device in the form of the sheet supply motor 77 and the sheet feeding motor 79 takes place after each one band of printing operation by the printing head 4, and the feeding movement of the paper sheet P is inhibited or the predetermined waiting time while the leftward movement of the carriage 5 is inhibited for the predetermined waiting time in the unidirectional non-margin printing operation. Thus, the feeding movement of the paper sheet P is inhibited while the amount of the ink mist floating between the printing head 4 and the paper sheet P is relatively large. In other words, the feeding movement of the paper sheet P into an area in which the floating ink mist exists in a relatively large amount, so that the area of contamination of the paper sheet P with the ink mist can be minimized.

In the illustrated embodiment, the NCU 67, MODEM 68, CODEC 69, I/F 81, telephone line 90, etc. are provided as a recording-information receiving device operable to receive recording information including recording data according to which the image is formed on the paper sheet P, and a portion of the control system assigned to implement step S21 functions as the above-described judging portion, which is arranged to determine whether the recording information includes the non-margin recording signal requesting the non-margin recording operation. The carriage-drive motor 25 is controlled such that the predetermined waiting time is provided when the judging portion has determined that the recording information includes the non-margin recording signal, but is not provided when the judging portion has not determined that the recording information includes the non-margin recording signal. Thus, the waiting time is provided or is not provided, depending upon whether the non-margin recording operation is performed or not.

Generally, a recording operation by an image-forming apparatus is performed according to recording information received through a receiving device from an external deice such as an external facsimile transmitter or an external computer, or according to recording information prepared by the operator of the image-forming apparatus. In the former case, the received recording information may or may not include the non-margin recording signal requesting that the non-margin recording operation is performed in the image-forming apparatus in question. In the latter case, the operator of the apparatus inputs this signal so that the recording information includes the signal. The waiting time is provided when the recording information received from the external device or prepared by the operator includes the non-margin recording signal, and is not provided when the recording information does not includes the non-margin recording signal.

Where the judging portion described above is provided, the image-forming apparatus assures a desired quality of the image printed in the non-margin recording operation, and a desired degree of recording efficiency, without a cumbersome operation by the operator to select or not to select the non-margin recording operation, even when the recording operation is performed according to the recording information received from the external device. Thus, the judging portion prevents an unnecessary quality of the printed image, or an unnecessarily high degree of quality of the printed image, in the non-margin recording operation according to the recording information received from the external device.

The above-described judging portion is also effective to determine whether the carriage 5 is returned or moved leftwards to the printing start position at the lower speed (4 ips) or at a speed substantially equal to the speed (40 ips) of the rightward movement, in the unidirectional non-margin printing operation, depending upon whether the received recording information includes the non-margin recording signal or not. That is, the carriage 5 is returned at the lower speed when the judging portion has determined that the recording information includes the non-margin recording signal, and at substantially the same speed as the speed of the rightward movement when the judging portion has not determined that the recording information includes the signal.

Where the judging portion is used to determine the speed of the return movement of the carriage 5 depending upon whether the received recording information includes the non-margin recording signal, the judging portion provides the same advantages as described above with respect to the provision of the waiting time.

While the preferred embodiment of this invention has been described in detail by reference to the accompanying drawings, for illustrative purpose only, it is to be understood that the present invention is not limited to the details of the illustrated embodiments, but may be embodied with various changes and modifications.

Although the non-margin printing operation in the example of the illustrated embodiment is performed without the top and bottom margins being left on the paper sheet P, the principle of the present invention is applicable to any non-margin printing operation in which an image is formed with ink droplets on the recording medium, without at least one margin left along any one of the top, bottom, right and left edges of the recording medium.

In the illustrated embodiment, the unidirectional non-margin printing operation in the high-quality mode is performed during each rightward movement of the carriage 5, and the carriage 5 is then returned leftwards to the unidirectional printing start position at which the next rightward movement of the carriage 5 is effected. However, the unidirectional non-margin printing operation may be performed during each leftward movement of the carriage 5. In this case, the carriage 5 is returned rightwards to the unidirectional printing start position.

While the illustrated embodiment permits the operator to select one of the four waiting times, namely, 0 second, 1 second, and 2 and 3 seconds, the waiting times available are not limited to those specific times. For instance, waiting times longer than 3 seconds may be selectively available. Further, it is possible to permit the operator to specify any desired length of waiting time. Where a predetermined fixed length of waiting time is available, the image-forming apparatus 1 may be provided with a waiting permitting/inhibiting switch operable by the operator to permit and inhibit the provision of the waiting time, and a waiting-time flag which is turned on and off according to on and off states of the enable/disable switch. In this case, the sheet-feeding and carriage-movement control routine of step S8 is modified to include a step of determining whether the waiting-time flag is in the on or off state, so that step S23 is implemented to permit the provision of the waiting time when the waiting-time flag is placed in the on state, but is skipped to inhibit the provision of the waiting time when the flag is in the off state. This waiting permitting/inhibiting switch and the waiting-time flag cooperate to function as a commanding device operable by the operator to selectively permit and inhibit the provision of the waiting time, and a portion of the control system assigned to execute the sheet-feeding and carriage-movement control routine modified as described above functions as the waiting-time control portion which is further arranged to provide the waiting time when the provision of the waiting time is permitted by the commanding device, and not to provide the waiting time when the provision of the waiting time is inhibited by the commanding device. This arrangement permits easy selection by the operator to provide or not to provide the waiting time, by merely operating the switch.

Although the illustrated embodiment permits the operator to select one of the two return speeds, namely, 40 ips and 4 ips, the return speeds are not limited to those speeds. For example, any desired return speeds not higher than 40 ips may be available. Further, more than three returns speeds may be selectively available.

The image-forming apparatus 1 may be provided with a low-speed-return permitting/inhibiting switch operable by the operator to permit and inhibit the return movement of the carriage 5 at 4 ips in the unidirectional non-margin printing operation, and a low-speed-return flag which is turned on and off according to on and off states of the low-speed-return permitting/inhibiting switch. In this case, the control routine of step S8 is modified to include a step of determining whether the low-speed-return flag is in the on or off state, so that step S25 is implemented to set 4 ips in the carriage-speed memory 63*a* when the low-speed-return flag is placed in the on state, but is skipped to inhibit the return movement of the carriage at 4 ips when the flag is in the off state. This low-return-speed permitting/inhibiting switch and the low-return-speed flag cooperate to function as a commanding device operable by the operator to permit and inhibit the return movement of the carriage at a speed lower than that of the rightward movement, and a portion of the control system assigned to execute the sheet-feeding and carriage-movement control routine modified as described above functions as the control device which is further arranged to permit the return movement of the carriage at the lower speed when the return movement at the lower speed is permitted by the commanding device, and inhibit the return movement of the carriage at the lower speed when the return movement at the lower speed is inhibited by the commanding device. The speed to be set in the carriage-speed memory 63*a* may be the speed selected by the operator, that is, the speed manually set in the return-speed memory 64*c*. This arrangement permits easy selection or non-selection by the operator of the lower return speed of the carriage 5, by merely operating the switch.

When the fixed waiting time before initiation of the carriage movement or the fixed low return speed of the carriage is available when the corresponding switch is placed in its on state, the manual operation required to be performed by the operator is simplified as compared with the manual operation of the operator's control panel 14 by the operator to select one of the plurality of waiting times or return speeds.

Even when the printing data received by the image-forming apparatus 1 include a non-margin printing signal requesting the non-margin printing operation, the waiting time before initiation of a movement of the carriage 5 may not be provided, or the carriage 5 may be returned at 40 ips, if the resolution of an image to be printed in the leading end portion (and/or the trailing end portion) of the paper sheet P is lower than a predetermined threshold, that is, if the amount of ink ejected to form an image in the leading end portion of the paper sheet P is so small that the leading end portion is not likely to be contaminated with the ink mist, in the non-margin printing operation. In this case, therefore, the non-margin printing operation can be efficiently performed, and the printed image has a relatively high-quality, even if the carriage is returned at the relatively high speed (40 ips), without the prior waiting time.

In the illustrated embodiment, the waiting time is measured by the CPU 61 by reading the time measured by the clock circuit 66. However, the waiting time can be measured by a timer including a time counter in which a count number corresponding to the waiting time is set. The count of the time counter is decremented according to signals generated at a predetermined time interval, until the counter is reduced to zero.

In the illustrated embodiment, the feeding of the paper sheet P as well as the movement of the carriage 5 is inhibited for the selected waiting time in step S23 of the sheet-feeding and carriage-movement control routine of S8. However, the paper sheet P may be fed while the movement of the carriage 5 is inhibited for the waiting time. Unlike the movement of the carriage 5, the feeding of the paper sheet P does not cause a considerable degree of generation of an ink mist. Accordingly, the feeding of the paper sheet P permits comparatively early initiation of the next one band of printing operation, without significant contamination of the paper sheet P with the ink mist, making it possible to assure high overall printing efficiency and a relatively high quality of the printed image.

According to the sheet-feeding and carriage-movement control routine of step S8, the special control of the carriage 5 (provision of the waiting time before initiation of the carriage movement, and the return movement of the carriage at 4 ips) is effected for only for the leading end portion of the paper sheet P which has the predetermined length from its leading edge in the sheet feeding direction A. Where the non-margin printing operation is performed without the right and left margins (with or without the top margin and/or the bottom margin), the special control of the carriage 5 may be applicable to the right and left edge portions of the paper sheet P which have predetermined width dimensions in the main scanning direction. This arrangement is effective to reduce a risk of contamination of the paper sheet with the ink mist in its right and left edge portions.

In the illustrated embodiment, the carriage movement speed 4 ips or 40 ips is written in the carriage-speed memory 63*a* before initiation of each movement of the carriage 5, so that the carriage 5 is moved at the speed stored in the carriage-speed memory 63*a*. However, the carriage-speed memory 63*a* may be replaced by a carriage-speed flag which is turned on when the carriage speed of 4 ips is selected. In this case, the carriage 5 is moved at 4 ips when the carriage-speed flag is placed in its on state, and at 40 ips when the flag is placed in its off state. While the carriage speed of 40 ips is written in the carriage-speed memory 63*a* and reference is made to this memory 63*a* even after the non-margin printing operation in the predetermined leading end portion of the paper sheet P is completed. However, the carriage speed of 40 ips is held effective after the completion of the non-margin printing operation in the leading end portion of the paper sheet P, without writing of the carriage speed in the carriage-speed memory 63*a*.

What is claimed is:

1. An image-forming apparatus comprising:

(a) a recording head operable to eject ink droplets for forming an image on a recording medium, (b) a movable body on which the recording head is mounted, (c) a driving device operable to reciprocate the movable body in a main scanning direction, (d) a medium feeding device to feed the recording medium in a secondary scanning direction intersecting the main scanning direction, and (e) a control device operable to control said recording head, said driving device and said medium feeding device, to perform a recording operation to form the image on the recording medium, the recording operation including a non-margin recording operation in which the image is formed with said ink droplets on the recording medium, without a margin left along an edge of the recording medium, wherein said control device includes a waiting-time control portion which is operable in said recording operation, to provide a predetermined first waiting time between a moment of termination of a movement of said movable body in one of opposite directions parallel to said main scanning direction and a moment of initiation of a subsequent movement of the movable body in the other of said opposite directions, and a predetermined second waiting time between said moments of termination and initiation when said non-margin recording operation is performed during the movement of the movable body in said one of the opposite directions, said predetermined second waiting time being longer than said predetermined first waiting time, said waiting-time control portion controlling said recording head such that the ink droplets are not ejected from the recording head during said predetermined first and second waiting times, and wherein said waiting-time control portion controls said recording head, said driving device and said medium feeding device such that said non-margin recording operation is performed without a top margin left along a leading edge of the recording medium, and such that said predetermined second waiting time is provided while the non-margin recording operation is performed in a leading end portion of the recording medium which has a predetermined special control length from said leading edge in said secondary scanning direction.

2. The image-forming apparatus according to claim 1, wherein said predetermined second waiting time is provided only while the non-margin recording operation is performed in said leading end portion of the recording medium.

3. The image-forming apparatus according to claim 1, wherein said predetermined first waiting time is substantially zero.

4. The image-forming apparatus according to claim 1, further comprising a time-measuring device operable to measure a time which has passed after the moment of termination of the movement of said movable body in said one of the opposite directions, and a time memory device storing data representing said predetermined second waiting time, and wherein said waiting-time control portion controlling said driving device such that the movement of the movable body in said other of the opposite directions is initiated when the time measured by said time-measuring device after said moment of termination of the movement of said movable body in said one of the opposite directions for said non-margin recording operation has exceeded said predetermined second waiting time represented by the data stored in said time memory device.

5. The image-forming apparatus according to claim 4, further comprising a time input device manually operable to store, in said time memory device, the data representing said predetermined second waiting time.

6. The image-forming apparatus according to claim 5, wherein said control device includes a speed control portion, which is operable in said non-margin recording operation, to control said driving device such that after said movable body is moved in said one of the opposite directions parallel to said main scanning direction while the image is formed by the recording head under the control of said control device, said movable body is moved in the other of said opposite directions at a speed lover than a speed of the movement of the movable body in said one of the opposite directions, while the image is not formed by said recording head under the control of said control device, said image-forming apparatus further comprising a speed input device manually operable to input data representing said lower speed at which said movable body is moved in said other of the opposite directions, and a speed memory device for storing the data input by said speed input device, and wherein said speed control portion controls said driving device to move said movable body in said other of the opposite directions at said lower speed represented by the data stored in said speed memory device.

7. The image-forming apparatus according to claim 1, further comprising a commanding device manually operable to permit provisioning of said predetermined second waiting time by said waiting-time control portion after said moment of termination of the movement of the movable body in said one of the opposite directions for said non-margin recording operation, said waiting-time control portion providing said predetermined second waiting time when provisioning the predetermined second waiting time is permitted by said commanding device, and providing said predetermined first waiting time when provisioning the predetermined second waiting time is not permitted by said commanding device.

8. The image-forming apparatus according to claim 1, wherein said waiting-time control portion controls said recording head, said driving device and said medium feeding device such that a feeding movement of the recording medium by said medium feeding device takes place after each recording operation by said recording head, and such that the feeding movement of the recording medium is inhibited for said predetermined first waiting time while the movement of said movable body in said other of the opposite directions is inhibited for said predetermined second waiting time after said moment of termination of the movement of the movable body in said one of the opposite directions for said non-margin recording operation.

9. The image-forming apparatus according to claim 1, further comprising a recording-information receiving device operable to receive recording information including recording data according to which the image is formed on the recording medium, and wherein said waiting-time control portion includes a judging portion operable to determine whether said recording information received by said recording-information receiving device includes a non-margin recording signal requesting said non-margin recording operation, said waiting-time control portion controlling said driving device such that said predetermined second waiting time is provided when said judging portion has determined that the recording information includes said non-margin recording signal, and said predetermined first waiting time is provided when said judging portion has not determined that the recording information includes said non-margin recording signal.

10. The image-forming apparatus according to claim 1, further comprising a recording-information receiving device operable to receive recording information including recording data according to which the image is formed on the recording medium, and wherein said speed control portion includes a judging portion operable to determine whether said recording information received by said recording-information receiving device includes a non-margin recording signal requesting said non-margin recording operation, said speed control portion controlling said driving device to move the movable body in said other of the opposite directions at said lower speed, when said judging portion has determined that the recording information includes said non-margin-recording signal, and at a speed substantially equal to that of the movement of the movable body in said one of the opposite directions, when said judging portion has not determined that the recording information includes said non-margin recording signal.

11. The image forming apparatus according to claim 1, wherein said waiting-time control portion provides said predetermined first waiting time when a normal recording operation is performed with said margin left along said edge of the recording medium, during the movement of the movable body in said one of the opposite directions.

12. The image-forming apparatus according to claim 1, wherein an operation of said medium feeding device to feed the recording medium in said secondary direction is inhibited during said predetermined second waiting time.

13. The image-forming apparatus according to claim 1, further comprising a device manually operable to select one of a plurality of different lengths of said predetermined second waiting time provided by said waiting-time control portion.

14. The image-forming apparatus according to claim 1, further comprising a speed control portion which is operable in said non-margin recording operation to control said driving device such that after said movable body is moved in said one of the opposite directions parallel to said main scanning direction while the image is formed by the recording head under the control of said control device, said movable body is moved in the other of said opposite directions at a speed lower than a speed of the movement of the movable body in said one of the opposite directions, while the image is not formed by said recoding head under the control of said control device.

15. The image-forming apparatus according to claim 14, wherein said speed control portion controls said recording head, said driving device and said medium feeding device such that said non-margin recording operation is performed without a top margin left along a leading edge of the recording medium, and such that said movable body is moved in said other of the opposite directions at said speed lower than the speed of the movement of the movable body in said one of the opposite directions, while the non-margin recording operation is performed in a leading end portion of the recording medium which has a predetermined special control length from said leading edge in said secondary scanning direction.

16. The image-forming apparatus according to claim 14, wherein said speed control portion controls said driving device such that said movable body is moved in both of said opposite directions at a substantially same speed, if the non-margin recording operation is performed during not only the movement of the movable body in said one of the opposite directions, but also the movement of the movable body in said other of the opposite directions.

17. The image-forming apparatus according to claim 14, further comprising a commanding device manually operable to permit the movement of said movable body in said other of the opposite directions at said lower speed, said speed control portion controlling said driving device to move the movable body in said other direction at said lower speed, when the movement of the movable body at said lower speed is permitted by said commanding device, and at a speed substantially equal to that of the movement of the movable body in said one of the opposite directions, when the movement of the movable body at said lower speed is not permitted by said commanding device.

* * * * *

UNITED STATES PATENT AND TRADEMARK OFFICE

CERTIFICATE OF CORRECTION

PATENT NO. : 7,588,300 B2
APPLICATION NO. : 11/236659
DATED : September 15, 2009
INVENTOR(S) : Yuji Koga et al.

It is certified that error appears in the above-identified patent and that said Letters Patent is hereby corrected as shown below:

On the Title Page, OTHER PUBLICATIONS:

Please insert --European Search Report based on European Patent Application No. 05256070.3--

Signed and Sealed this

Twenty-sixth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,588,300 B2
APPLICATION NO. : 11/236659
DATED : September 15, 2009
INVENTOR(S) : Koga et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 299 days.

Signed and Sealed this

Twenty-first Day of September, 2010

David J. Kappos

David J. Kappos
*Director of the United States Patent and Trademark Office*